US012758851B2

(12) United States Patent
Zirinsky et al.

(10) Patent No.: US 12,758,851 B2
(45) Date of Patent: Oct. 13, 2026

(54) SCOREBOARD CONTROLLER

(71) Applicants: Kellie Felicia Zirinsky, Schwenksville, PA (US); Michael G. Lyons, Harleysville, PA (US)

(72) Inventors: Michael W. Zirinsky, Schwenksville, PA (US); Michael G. Lyons, Harleysville, PA (US); Evan Grier Comisac, Baltimore, MD (US); Mason Peter Black, San Francisco, CA (US); Philip Gregory Kaufinger, Kutztown, PA (US); Ryan Joseph Burke, Philadelphia, PA (US); Declan Coster, New York, NY (US); Robert DiMartino, Upper Saddle River, NJ (US); Noah Rose, Albequerque, NM (US); Yukang Kuang, Seattle, WA (US)

(73) Assignees: Kellie Zirinsky, Schwenksville, PA (US); Michael Lyons, Harleysville, PA (US)

( * ) Notice: Subject to any disclaimer, the term of this patent is extended or adjusted under 35 U.S.C. 154(b) by 236 days.

(21) Appl. No.: 17/901,227

(22) Filed: Sep. 1, 2022

(65) Prior Publication Data

US 2023/0264096 A1 Aug. 24, 2023

Related U.S. Application Data

(60) Provisional application No. 63/239,626, filed on Sep. 1, 2021.

(51) Int. Cl.

| | |
|---|---|
| ***A63B 69/00*** | (2006.01) |
| ***A63B 71/06*** | (2006.01) |
| *A63B 102/18* | (2015.01) |

(52) U.S. Cl.

CPC ..... *A63B 71/0669* (2013.01); *A63B 2102/18* (2015.10); *A63B 2102/182* (2015.10); *A63B 2220/17* (2013.01)

(58) Field of Classification Search

CPC ..... A63B 71/0669; A63B 2102/18; A63B 2102/182; A63B 2220/17; G08C 2201/30; G08C 17/02; G06F 3/0219

USPC ..... 340/323, 323 R

See application file for complete search history.

(56) References Cited

U.S. PATENT DOCUMENTS

| | | | | |
|---|---|---|---|---|
| 5,181,009 | A * | 1/1993 | Perona | G04B 37/12 273/DIG. 26 |
| 5,877,480 | A * | 3/1999 | Tuso | A63B 71/06 235/1 B |
| 7,967,188 | B2 * | 6/2011 | Hickox | A63B 71/0672 235/1 B |
| 10,531,137 | B1 * | 1/2020 | Matak | A63B 24/0062 |
| 2001/0017615 | A1 * | 8/2001 | Lin | H03J 1/0025 345/173 |
| 2005/0242137 | A1 * | 11/2005 | Fishman | A01K 27/001 224/221 |

(Continued)

*Primary Examiner* — Tai T Nguyen

(74) *Attorney, Agent, or Firm* — Collard & Roe, P.C.

(57) ABSTRACT

There is a hand held device for controlling a scoreboard comprising a housing having a plurality of faces comprising front face, a right side face, a back face, a left side face, a bottom face, and a top face. There is a display screen coupled to the housing wherein there are a plurality of buttons coupled to the housing. There is also at least one face of said plurality of faces is curved.

19 Claims, 23 Drawing Sheets

(56) References Cited

U.S. PATENT DOCUMENTS

| | | | | |
|---|---|---|---|---|
| 2007/0030128 | A1* | 2/2007 | Hills | A63B 71/06 340/323 R |
| 2009/0033514 | A1* | 2/2009 | Yamagiwa | G08C 17/02 340/4.31 |
| 2009/0096593 | A1* | 4/2009 | Dakers | A63B 71/0686 700/91 |
| 2011/0032086 | A1* | 2/2011 | Cabrera | A63B 71/0669 340/323 R |
| 2011/0140847 | A1* | 6/2011 | Schafer | G08C 23/04 340/7.51 |
| 2012/0255482 | A1* | 10/2012 | Terenzoni | A63B 71/0672 116/223 |
| 2014/0379868 | A1* | 12/2014 | Nault | G06F 16/176 709/219 |
| 2018/0246622 | A1* | 8/2018 | Lee | G06F 3/04883 |
| 2023/0381629 | A1* | 11/2023 | Beal | A63B 71/0669 |

* cited by examiner

FIG. 11A
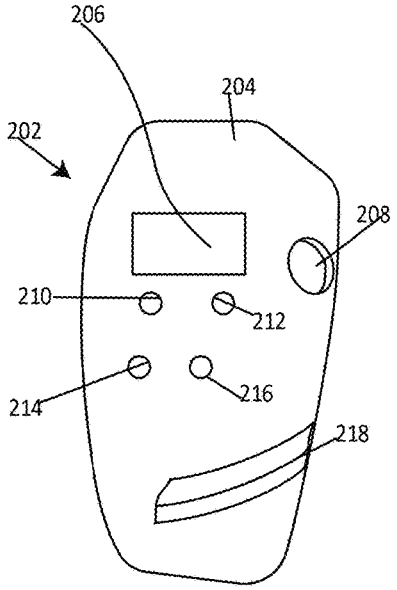
FIG. 11B
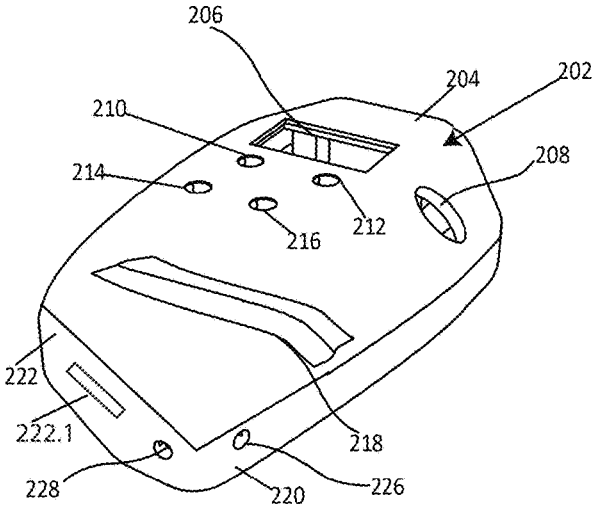
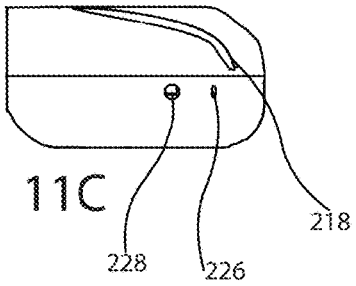
FIG. 11C
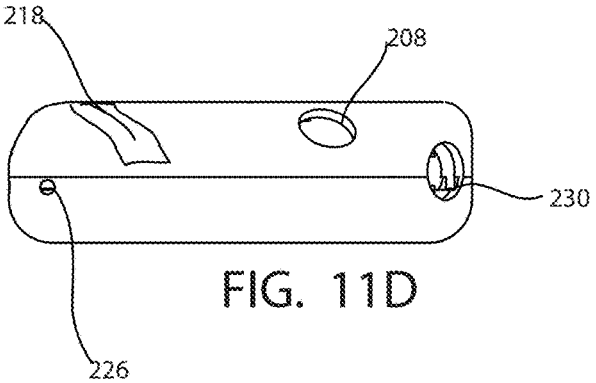
FIG. 11D

SCOREBOARD CONTROLLER

CROSS REFERENCE TO RELATED APPLICATIONS

This application claims priority from Provisional Application Ser. No. 63/239,626 filed on Sep. 1, 2021 the disclosure of which is hereby incorporated herein by reference.

BACKGROUND OF THE INVENTION

One embodiment of the invention relates to a scoreboard controller which is configured to control the scoreboard in an efficient manner. Umpires and scorekeepers are under a lot of pressure to score games rapidly and accurately such as baseball and softball games. Therefore, there is a need for a handheld remote control scoreboard type device which is efficient in design, easy to use and compact.

SUMMARY OF THE INVENTION

One embodiment of the invention relates to a scoreboard controller which is configured to control the scoreboard in an efficient manner. The invention can be formed as an ergonomic handheld device which is configured to allow a user to keep score and to allow the user to easily change the score or update the score, innings, periods, and time in an easy and efficient manner. For example, there can be a device having a body which is curved and efficient in design which has a plurality of buttons disposed thereon along with a screen disposed therein. While any suitable buttons can be used, the buttons can be for a screen functionality button, a strikes button, an outs button, a balls button an innings button a run button (optional), an on base button (optional) as well as other functionality buttons. There can also be an undo button so that if the score or the outs or the strikes are recorded in error, the user can undo the latest data input.

Thus, there is created a compact, easy to use and efficient scoreboard controller which can be used by umpires, parents or officials.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 11A is a front view of another embodiment of the device;

FIG. 11B is a perspective view of the device;

FIG. 11C is a bottom view of the device;

FIG. 11D is a side view of the device;

DETAILED DESCRIPTION OF PREFERRED EMBODIMENTS

Figure 1:
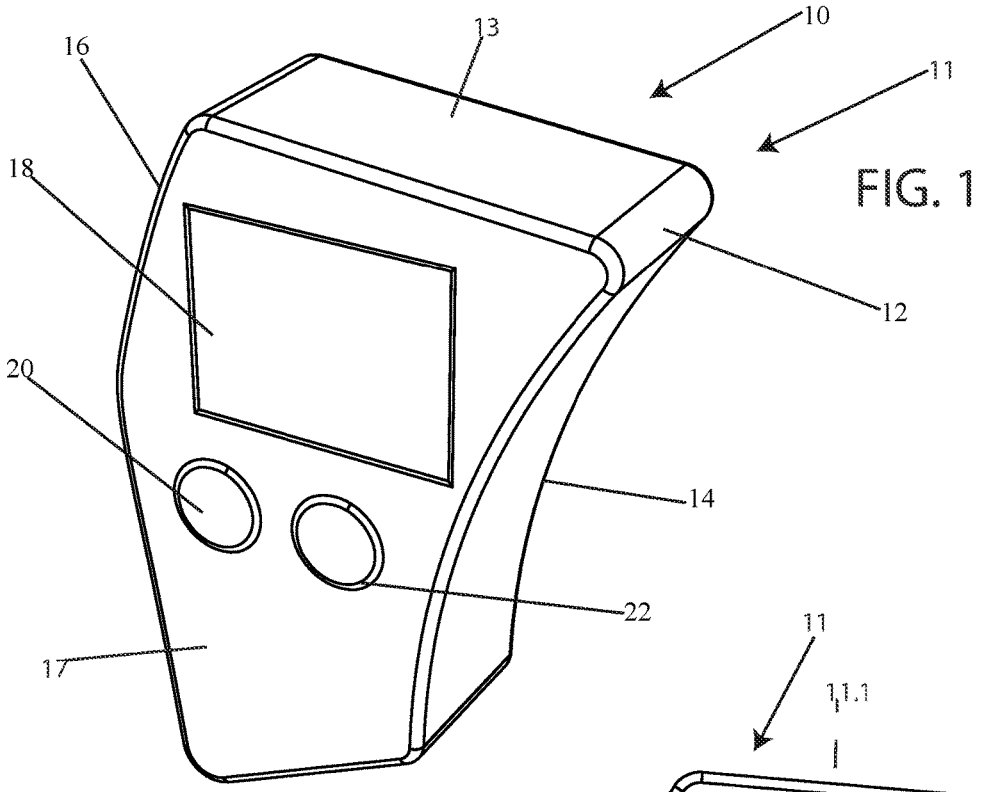
FIG. 1 is a side perspective view of a first embodiment which shows a screen as well as user buttons and a curved housing.

Referring to the drawings, FIG. 1 shows an isometric view of a first embodiment which includes a body section or housing 11 which is a curved or angled ergonomic body having a fillet corner 12 a top side 13, a right side 14, a left side 16 a front face 17. There is also a bottom side 32 (See FIG. 3) as well as a back side (not shown). Disposed on the front face is a screen 18, as well as buttons 20 and 22. Screen 18 can be in the form of any suitable screen such as a TFT, LCD, LED or any other suitable type of screen. Screen functionality button 20 is disposed adjacent to screen 18. Screen functionality button 20 is configured to change screens when suitable or even brighten or darken the screen. Screen functionality button 20 works as a screen functionality button when the button is held down for example 5 seconds. If the user presses on button 20, it operates as a runs button. Button 22 is an undo button if the user holds the button down for 5 seconds so that if the user selects another button for use such as runs, outs, strikes, balls etc. but presses this button in error, the user can simply select undo button 22 to undo this selection. In addition button 22 is a start game button wherein the user only presses it briefly (under 5 seconds) and this starts the clock on the game.

Figure 2:
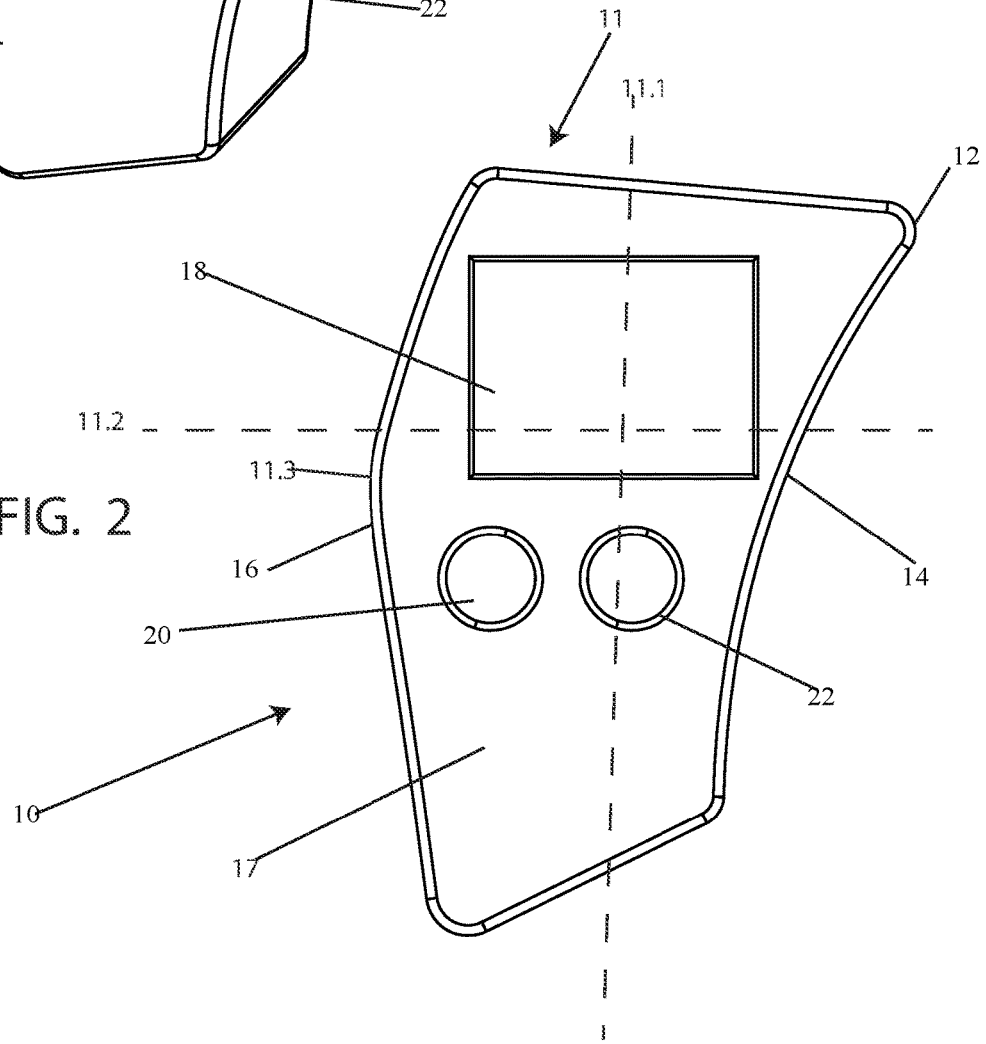
FIG. 2 is a front view of the embodiment of FIG. 1.

FIG. 2 is a front view of the embodiment of FIG. 1. In this view, there is also shown front face 17 which is configured to house buttons 20 and 22 on that face. Screen 18 is also shown as a substantially rectangular screen, however in other embodiments the screen can be square, circular, oval or rounded. As discussed above, button 20 is a screen functionality button and button 22 is an undo button. A portion of left side 16 is shown as well as a portion of right side 14. Right side 14 is concave, while left side 16 is convex so that the housing 11 fits inside of a user's hand in an ergonomic manner. FIG. 2 also shows that the housing 11 is approximately kidney bean shaped with a first extension along a longitudinal axis 11.1 (long axis) and a second extension along a latitudinal axis 11.2 (width axis). There is a bend 11.3 in housing 11 which is the apex of the lateral curve in the housing allowing for the curved or kidney bean shape of the housing. The housing 11 is shaped this way so that it can ergonomically fit inside of a user's hand.

Figure 3:
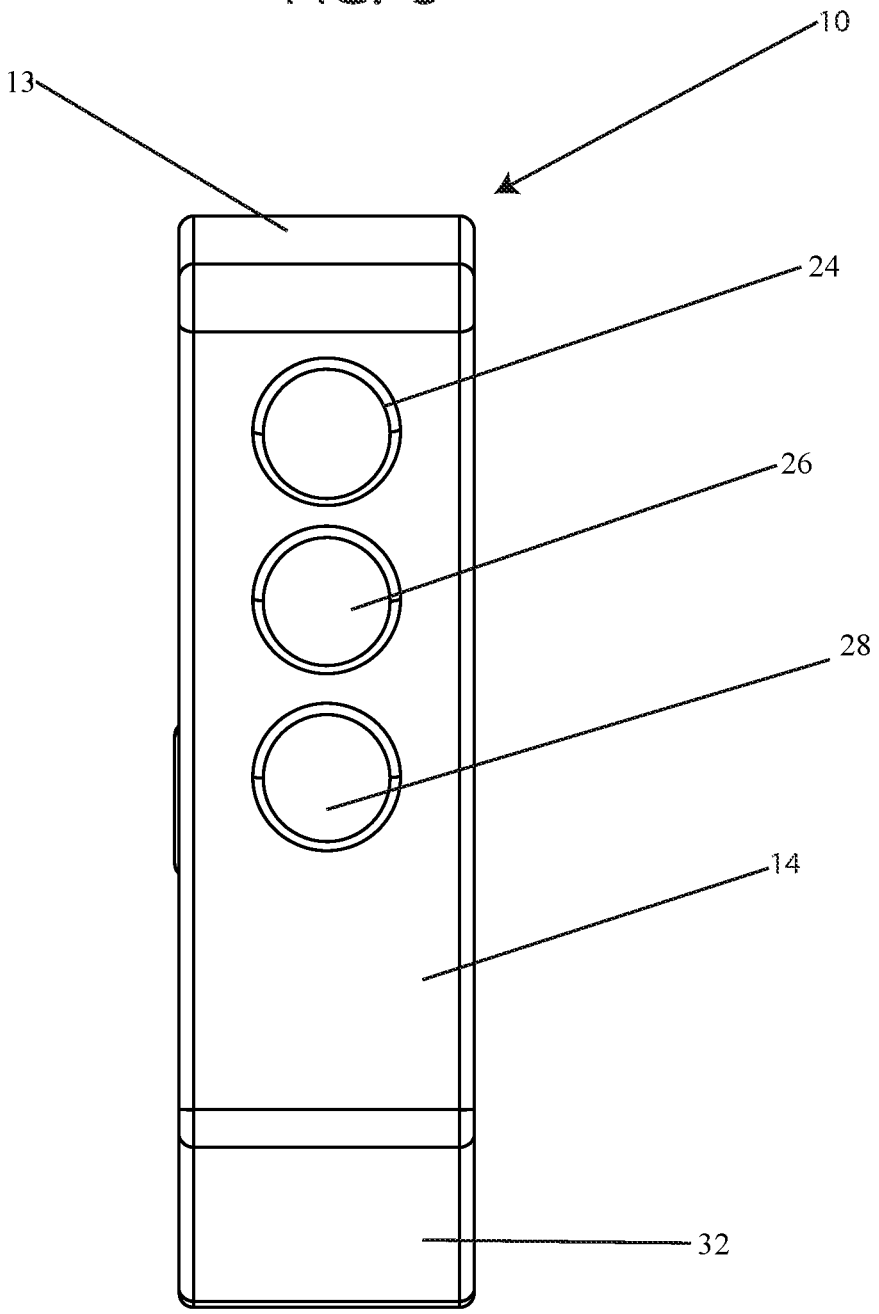
FIG. 3 is a right side view of the embodiment shown in FIG. 1.

FIG. 3 shows a right-side view which shows top face 13, buttons 24, 26 and 28 as well as right side 14. Buttons 24, 26 and 28 are not shown in FIGS. 1 and 2 because FIGS. 1 and 2 are simplified views, however in this embodiment these buttons are shown. While the three buttons 24, 26 and 28 can be any suitable button, button 24 is a strikes button, while button 26 is an outs button and button 28 is an innings button. Thus, when a user presses on button 24 the strike count increases incrementally by a count of 1. This count would register on screen 18 as well as on an associated scoreboard. If however, the strike count was inaccurate, the user could either hit button 24 additionally (to raise the strike count) or hit the undo button 22 to reduce the strike count if the last hit button was the strike button/foul ball button 24. When the strike count increases to two and the user hits the strike button/foul ball button 24, the strike count incrementally raises to 3, and then resets to 0. Next, the outs count automatically increases by 1. Accordingly, button 26 is the outs button. This button can be pressed when a user indicates that an out has been created such as when a user is either tagged out, an outfielder catches a ball, or the user is thrown out at first base. If the strike count was set for example at 2 and the batter hits the ball resulting in an out and the user presses the out button 26, this would automatically incrementally raise the out count while resetting the strike count and the ball count to zero (0). Alternatively, the device can be set up so that the strike total cannot proceed past two (2) and the umpire would then press the out button 26

In addition, there is an innings button 28, when the out count reaches 3 or when the last play of the inning is achieved, the innings count can increase. For example, if the game is at the bottom of the 1st inning and the user selects the strike button/foul ball button 24 when there are already two strikes and two outs, this can automatically roll the inning count to 2. Alternatively, a microprocessor such as microprocessor 55 (See FIG. 5) can be programmed such that the device can hold this count at 3 strikes 2 outs, and the user can then press the inning button 28 to incrementally increase the inning to the second inning. Alternatively, if there is for example, one out on the scoreboard, and a batter hits into a double play or if there are two outs on the scoreboard and the batter flies out, the umpire can simply hit the innings button 28 to advance from the bottom of the first inning to the second inning. The hitting of the innings button 28 results in a clearing of the strike count, ball count, and the outs count. In addition, disposed below the innings button 28 is the bottom face 32 which is configured as either a rounded concave face, a flat face or a rounded convex face to suit the ergonomic preferences of the user.

Figure 4:
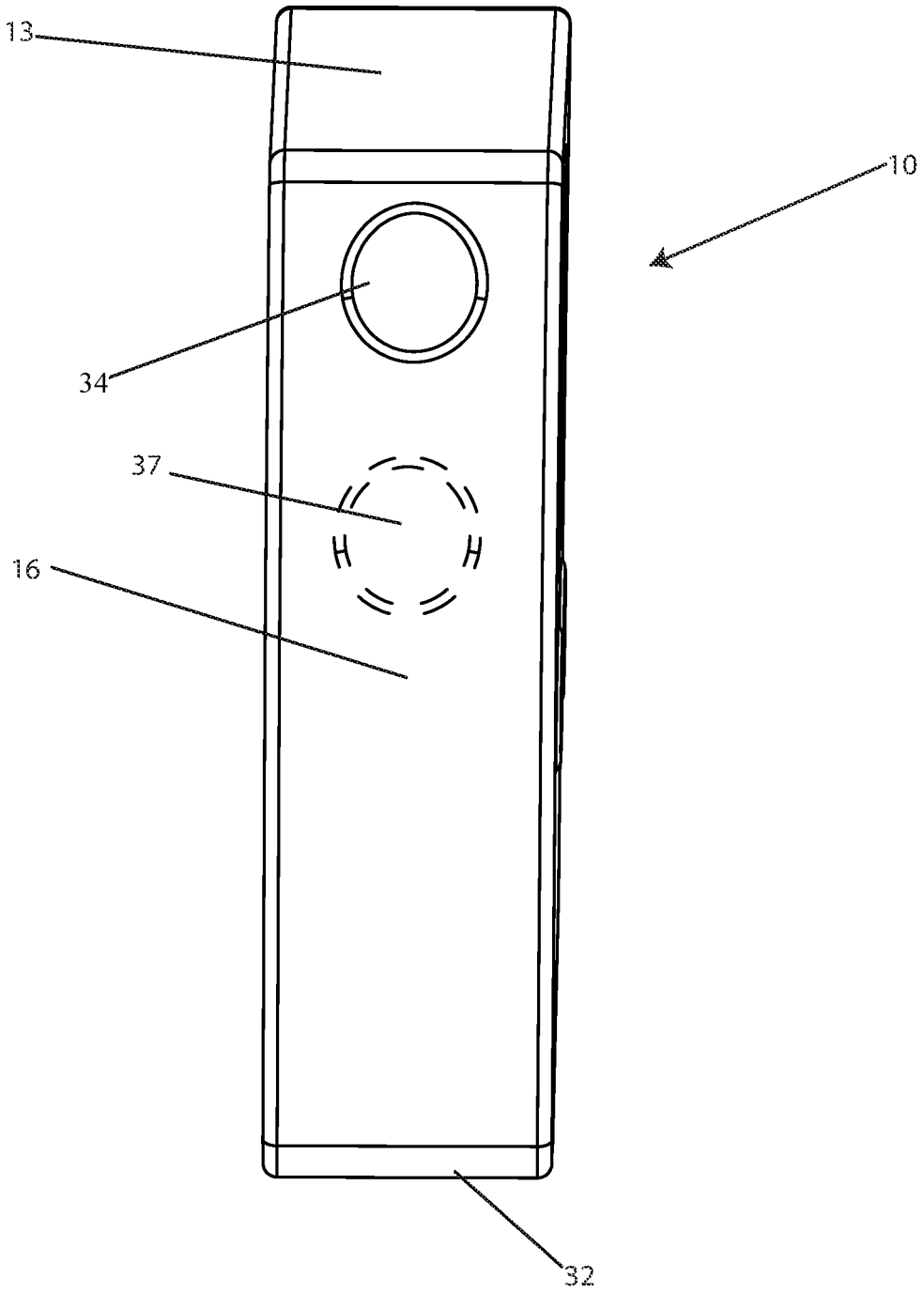
FIG. 4 is a left side view of the embodiment of FIG. 1.

FIG. 4 is a left side view of the device 10 which shows balls button 34 on left side 16 as well as top face 13. Bottom face 32 is also shown as well. This view also shows an optional additional button 37 as well. This optional additional button can be programmed to have additional features such as a runs button, an error button or any other suitable button for use such as for recording balls.

Figure 5:
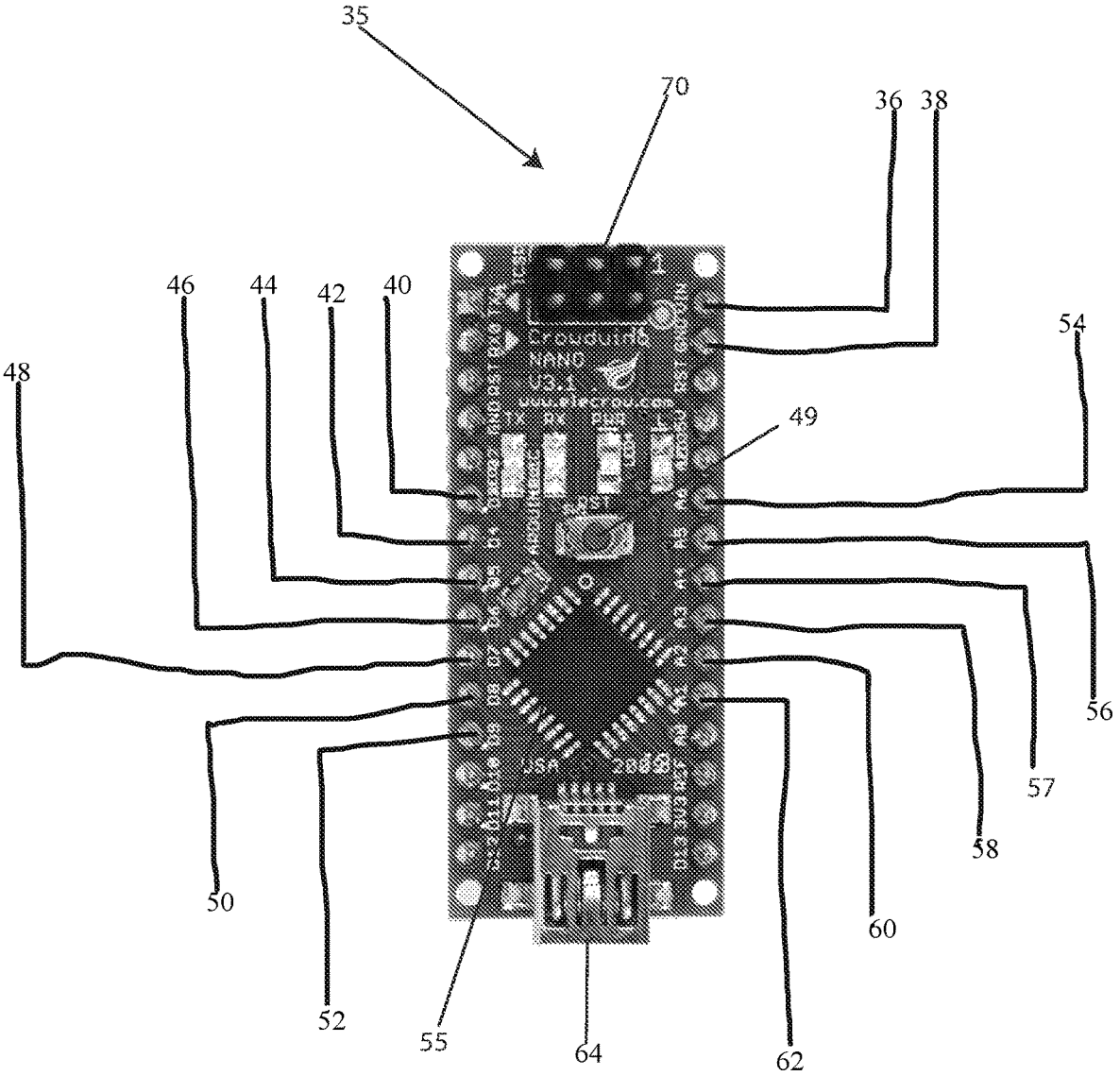
FIG. 5 is a view of the circuit board.

FIG. 5 is a view of the circuit board PCB or motherboard 35 which has a plurality of screen functionality contacts 40, 42, 44, 46, for use with the screen functionality button 20, as well as a screen display output 48. There is also a timer display contact 50 which is an output for displaying the time of day and/or game. There is also a contact 52 for a timer functionality button. A contact 54 is a contact for the balls button 34, while a contact 56 is for the strikes button 24. Contact 57 is for the outs button 26. Contact 36 is for the battery voltage input while contact 38 is for the ground input. Disposed in a central region of the circuit board is the microprocessor 55. This microprocessor is programmable so that it can be programmed to change the functionality of the different buttons either through the mini USB jack or contact 64 or through the contact 70 for in circuit serial programming. The circuit board can also include an annunciator such as annunciator 49 which is configured to either indicate an audible beep and/or vibrate the device depending on the type of annunciator.

Contact 58 is for the innings button 28 while contact 60 is for the new count button. Contact 62 is for the undo button 22, while contact 64 is the mini USB jack so that a user can have an input/output connection to the motherboard. Contact 70 is a contact for in circuit serial programming. Thus, this motherboard can be programmed or controlled via contacts 64 (USB) or contact 70 (in circuit serial programming). This controller or motherboard 35 can then be in communication in either a wired manner or in a wireless manner with an outside computer device such as a computer or server, a repeater, or a scoreboard.

Figure 6:
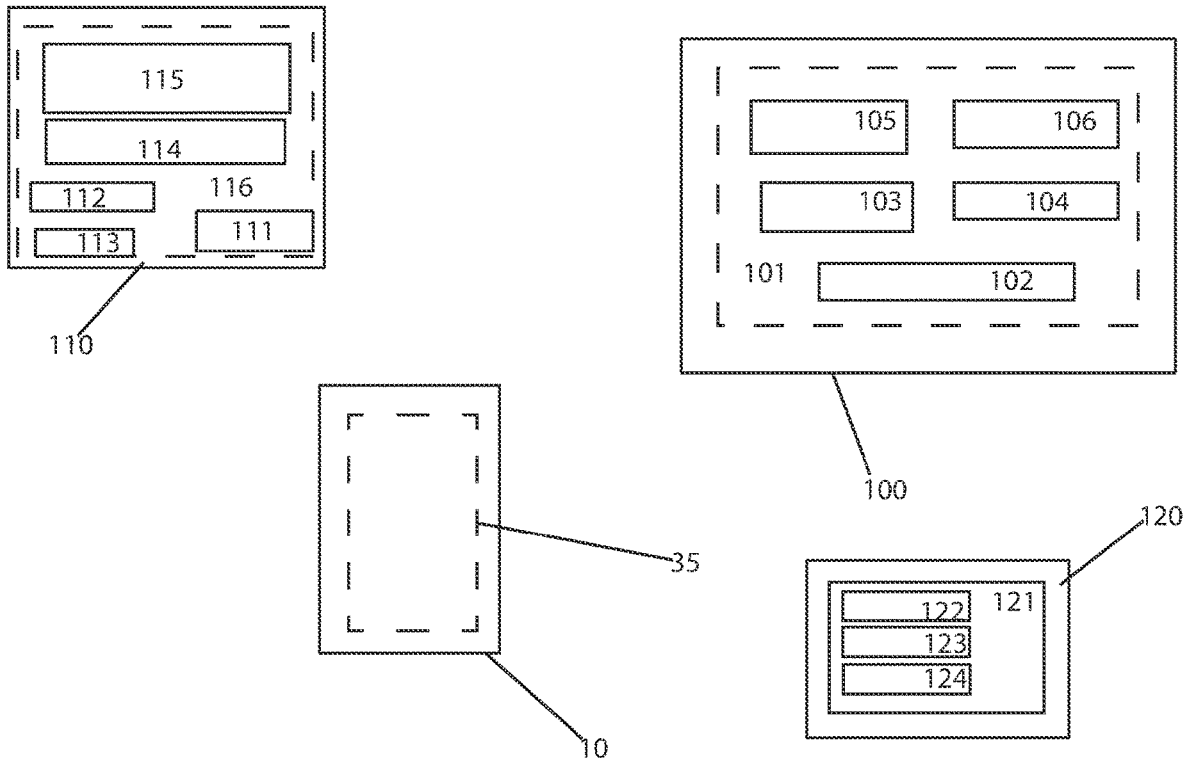
FIG. 6 is a schematic block diagram of the computer network.

For example, as shown in FIG. 6, there is shown a layout of components such as the device 10 having motherboard 35. This device can be in communication with an outside central computer or server 100 as well as with a scoreboard 110. The communication between these devices can be in a wireless form such as radio frequency, WIFI, Bluetooth, cellular or any other suitable form of wireless or wired communication. For example, there is shown server 100 having a motherboard 101, along with a transceiver 102 which can be either a wireless transceiver such as WIFI, Bluetooth or another form of wireless and/or wired communication portal. There is also a processor such as a microprocessor 103, a memory 104, a power supply 105 as well as an input/output port for any one of a keyboard, a video screen or mouse.

There is also a scoreboard 110 which has a motherboard 116. Coupled to the motherboard is a processor 111 such as a microprocessor, there is also a memory 113, and a transceiver 112 which is configured to receive signals from motherboard 35 or from transceiver 102 in server 100. There is also a video driver 114, as well as a video screen 115 which provides the video output for the device.

Thus, the device 10 with motherboard 35 can communicate with an outside server 100 or directly with a scoreboard 110. Alternatively, the scoreboard 110 can communicate with the outside server and relay communications from device 10 to server 100 or receive communications from server 100 and relay these communications to device 10.

In addition, there is also an optional relay 120 having a motherboard 121 which is configured to contain a transceiver 122, a microprocessor 123 and a memory 124 as well as other necessary components to relay a signal either to the server 100 or to the scoreboard 110. Thus, the device 10 is configured to communicate with the relay if the other components are out of reach. The communication with the relay can be in the form of a communication via WIFI, Bluetooth, radio waves, cellular, or any other form of communication means.

Thus, there is a simple ergonomic device which has a convenient set up for buttons thereby allowing the user to adjust the scoring on a scoreboard such as scoreboard 110 in a rapid and easy manner.

Figure 7:
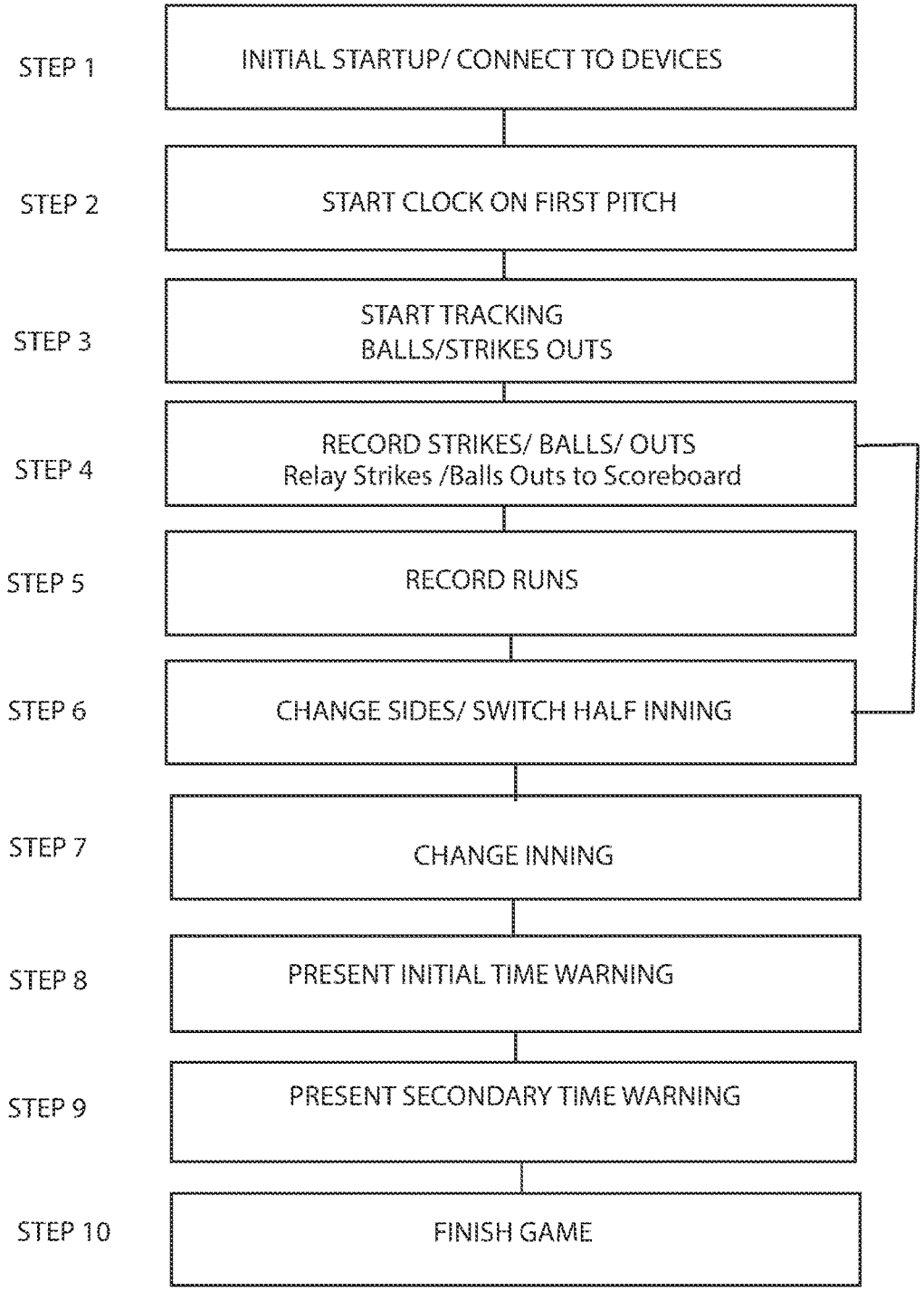
FIG. 7 is a flow chart for the process for using the device in a game.

FIG. 7 shows the flow chart for the operation of the device. This flow chart is substantially controlled by a processor such as the microprocessor 55 which can have/has an on board memory which has the programming loaded thereon. For example, the process starts in step 1 wherein there is an initial startup. This initial startup is started when the user presses on the screen functionality button 20. By pressing on the screen functionality button this turns the device on. The user can either press and hold the button to turn it on or press and hold the button to turn it off once the device is turned on. Once the device is turned on, the umpire or user can then track the events in the game such as strikes, balls, outs, runs, etc. Therefore, in step 2 once the game starts, a pitcher pitches the ball wherein upon the pitch of the ball either a strike, out, hit or other event is recorded. For purposes of starting the clock, if the clock has not already started on the game, the umpire can select any one of the strikes, balls, outs button, and or any other suitable button to start the clock on the game.

Thus, for example if the first pitch is a strike the umpire can hit the strikes button which records a strike (see step 3) and also starts the clock. However if the first pitch is neither a strike or a ball, or an out, such as a hit, the umpire can press button 22 (the undo button) for less than 5 seconds to start the timer.

Upon this first event, this step starts the clock in step 3. In a standard little league game such as a Pop Warner or Cal Ripken league, games can be controlled for time such that once a pre-set time period has been reached, the players have to finish the inning that crosses an initial threshold. In at least one embodiment, steps 2 and 3 can occur simultaneously.

After the clock has started, (see contact 52 for the timer functionality) the process moves to step 4 wherein these strikes/balls/outs and/or hits are sent to the scoreboard. The strikes are recorded by having the umpire press the strikes button 24 which signals to the strikes button contact 56 on the motherboard. Alternatively, the balls are recorded when the user presses the balls button 34 which signals the balls button contact 54 on the motherboard. Next, in step 5 the user/umpire can record the runs scored by the users. When the outs have reached the maximum of three outs/the system then changes the scoreboard to reflect the change of sides to end the half inning. Next, the process proceeds back to step 4 wherein the system records the strikes, balls, outs recorded or input by the umpire during the game. When this half inning proceeds through the three outs in this half of the inning, then the system automatically proceeds to step 7 wherein it changes the inning upon reaching the final out in the bottom of the previous proceeding inning. Thus, the system proceeds to step 7 wherein it changes the inning. During the game, wherein the game proceeds through the successive progression of innings, it can either finish the game within a pre-set time period such as within two (2) hours or it can present an initial time warning in step 8.

For example, in some leagues, such as described above, if the timer on the clock proceeds past a pre-set time limit such as 1 hour 45 minutes, then the teams must resolve the game within the inning that crosses the 1 hour 45 minute mark. Thus, there can be an optional initial time warning such as a time warning presented in step 8 at the 1 hour 40 minute mark to indicate to the players to speed up the game. Next, in step 9 the secondary time warning at the 1 hour 45 minute mark can be presented so that the inning that the players are in during this time threshold becomes the last inning of the game. The indicators for these time limits can be in the form of an audible beep and/or vibration such as through annunciator 49 on the circuit board. This audible beep and/or vibration put off by the device to indicate to the umpire of the time period/alarm. With this time alarm, this allows the teams to resolve their games substantially within a two hour time period thereby freeing up fields for other games as well as allowing parents to schedule their time in a pre-set manner.

Figure 8A:
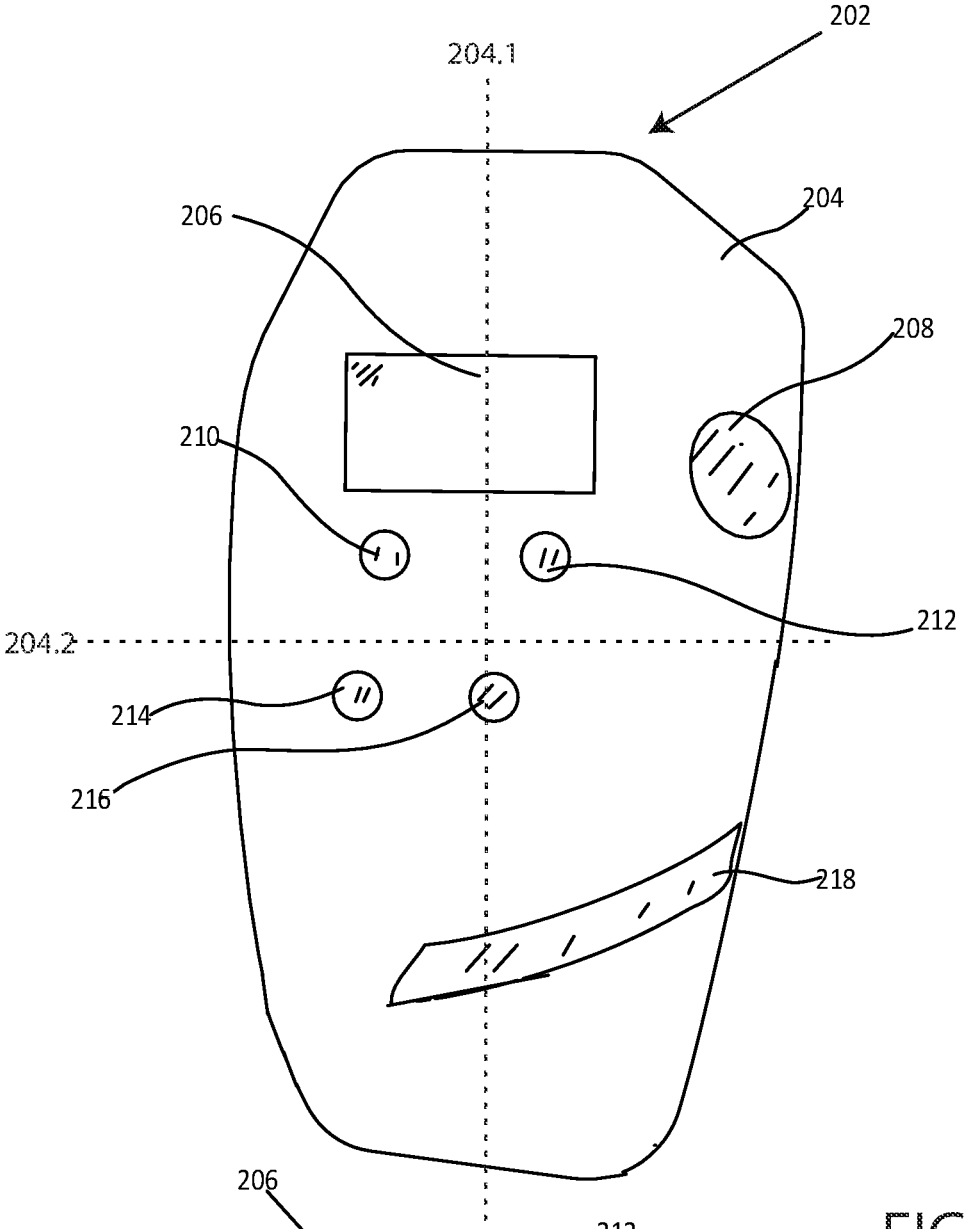
FIG. 8A is a front view of another embodiment.

FIG. 8A is a front view of another embodiment 202 which shows a case 204 which has a screen 206 and a plurality of different buttons. For example, there is shown a first button 218 which is a first substantially round button as shown in further detail in FIGS. 12A-12D. These buttons 208, 210, 212, 214 and 216 and 218 are for controlling the scoring on the device. The housing of the device is configured to fit a hand of an umpire and is configured in an oblong shape which is fatter at a top portion near screen 206 and narrower at a bottom portion closer to button 218. In this view the housing or case 204 extends along a longitudinal (long) axis 204.1 and along a latitudinal axis 204.2. The case or housing is substantially rounded in a substantially oval or oblong shape. The shape is configured to fit inside of a user's hand in an ergonomic manner.

Figure 8B:
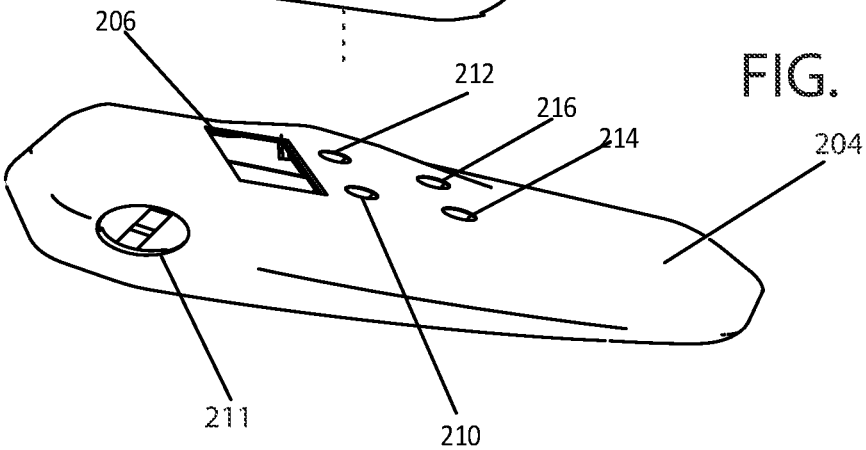
FIG. 8B is a side view of the embodiment of FIG. 8A

FIG. 8B is the side view of the embodiment of FIG. 8A. This view shows button 211 which in a first embodiment is the primary button for strikes/foul balls. Button 208 is the primary button for balls, button 210 is the primary button for innings, button 212 is the primary button for runs, button 214 is the primary button for undoing the previous event, while button 216 is the primary button for a stopwatch. Not shown in this view is button 230 which is the primary button for outs. In at least one alternative embodiment, button 218 is instead a ridge which allows a user to place his/her hand on the device.

Figure 9A:
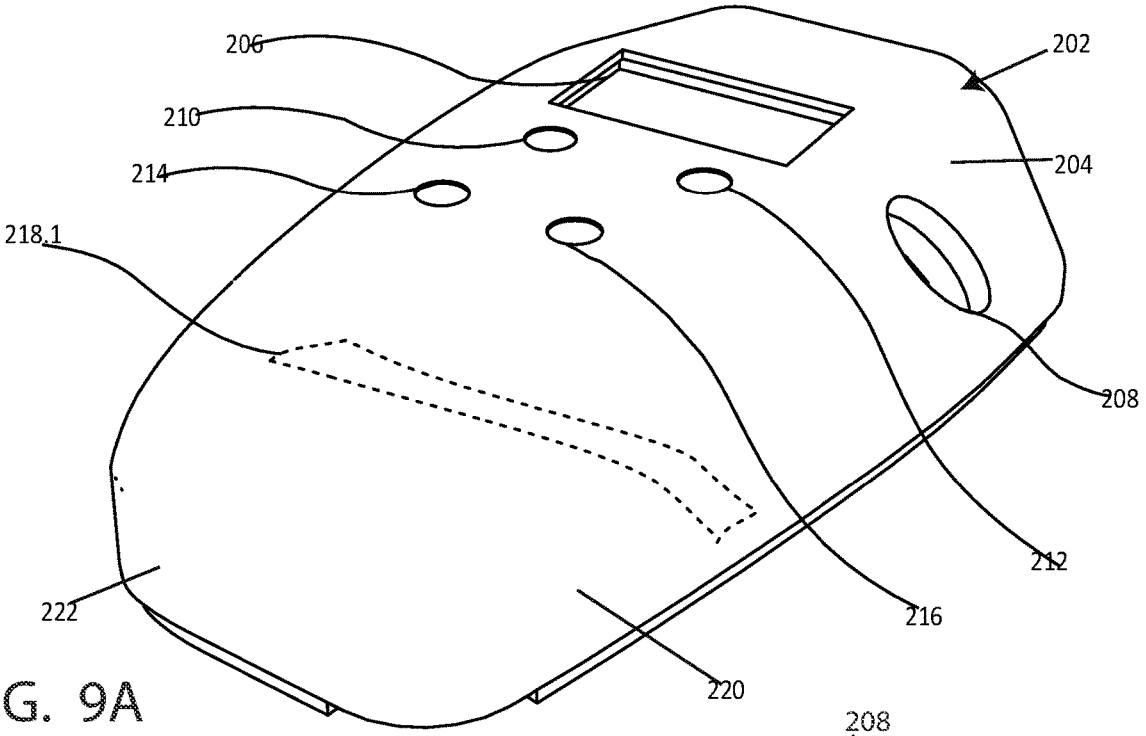
FIG. 9A is a top perspective view of the cover
Figure 9B:
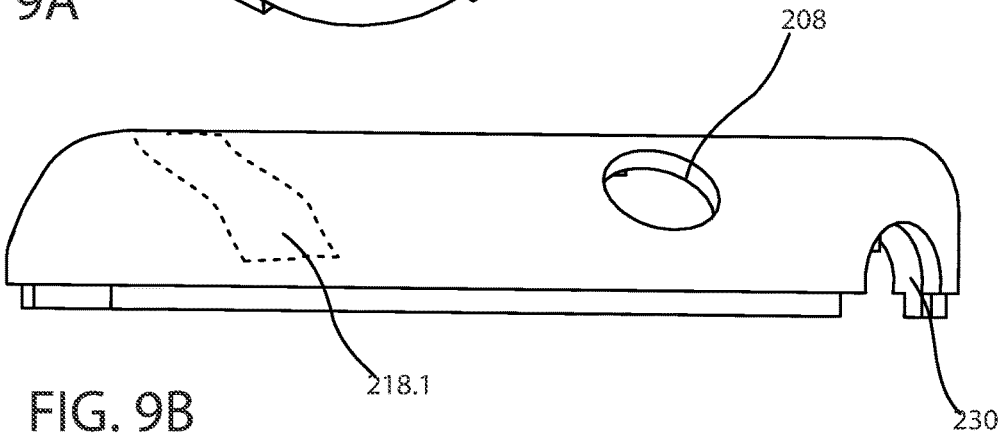
FIG. 9B is a side view of the cover.
Figure 9C:
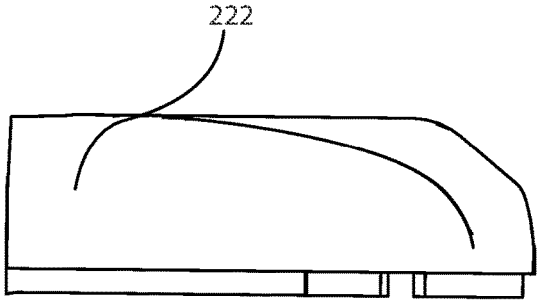
FIG. 9C is a bottom view of the cover.

FIGS. 9A, 9B and 9C show body 202 which shows a rounded front as well as openings 206.1 208.1 210.1, 212.1, 214.1 and 216.1. which correspond to buttons 208, 210, 212, 214, 216. In this view there is also an optional finger rest 218.1 in place of button 218. There are also side walls 220 and 222 shown as well.

Figure 10A:
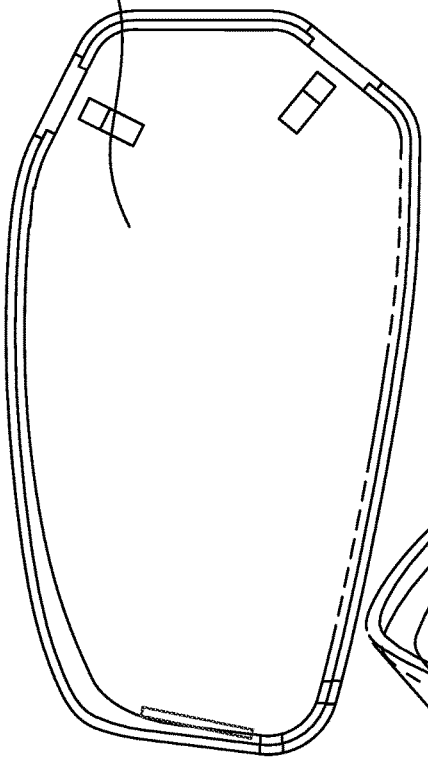
FIG. 10A is a front view of the back cover.
Figure 10B:
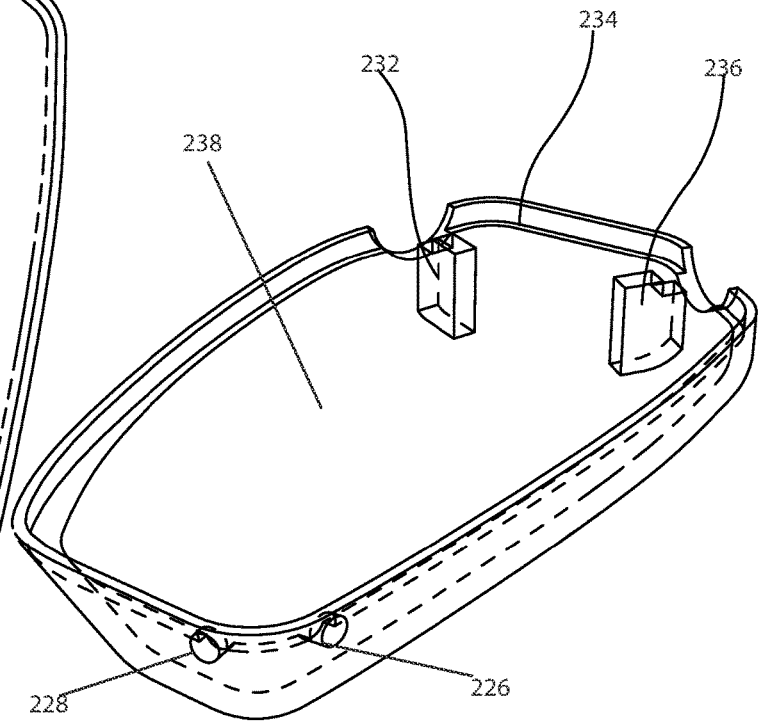
FIG. 10B is a perspective view of the back cover.
Figure 10C:
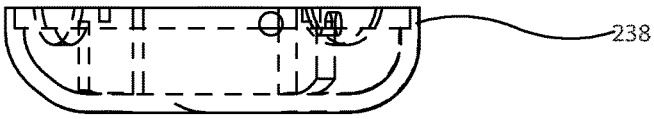
FIG. 10C is a bottom view of the back cover.
Figure 10D:
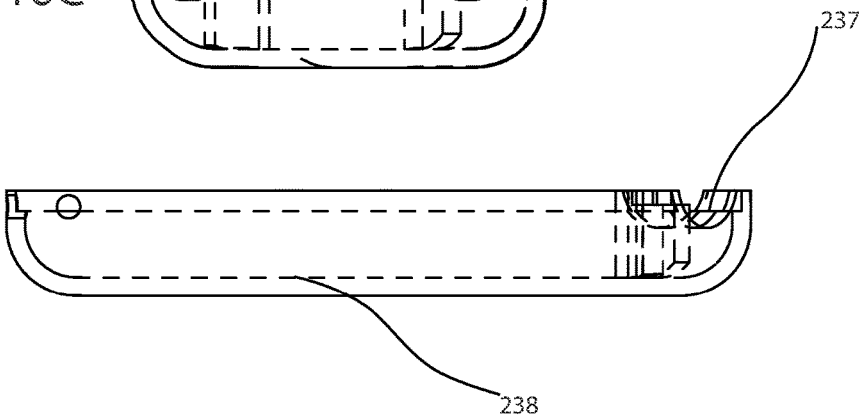
FIG. 10D is a side view of the back cover.

FIGS. 10A, 10B, 10C and 10D show the backing portion of the housing which shows backing piece 238. Backing piece 238 includes a body section, as well as braces or supports 232 and 236. There is also an upper rim 234 as well. The body section 238 is formed as a clamshell for receiving a circuit board as well. FIG. 10D also shows body 238 as well as button opening 237.

FIGS. 11A, 11B, 11C, and 11D is a front view of another embodiment. For example, there is a view of embodiment 202.1 there is shown body section 204, screen 206, button 208, buttons 210, 212, 214, and 216. Buttons 210, 212, 214, and 216 are configured as described above. There is also button 218 as described above. In addition, with this view there is an input channel 222.1 such as a USB related input such as a USB-C input. This view also shows body section having a longitudinal axis 204.1 and a latitudinal axis 204.1. As discussed above, case 204 is a rounded shape with an oblong cross-section which is styled to be an ergonomic design to fit inside of a user's hand and to make the pressing of buttons easy by an umpire.

In addition, there is a tether hole 226 on side 220 while tether hole 228 is on side 222. These tether holes 226 and 228 are for feeding in a lanyard, tether or strap to allow an umpire to keep the device secured to their hand or wrist.

In addition, in FIG. 11D there is shown another button 230 as well which is configured as an outs button.

Figure 12A:
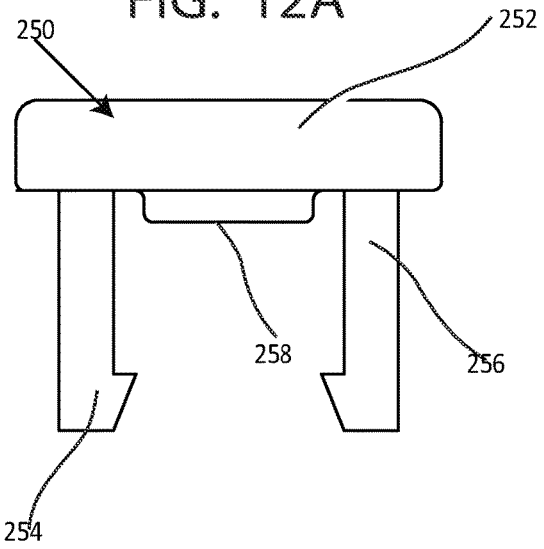
FIG. 12A is a side view of a button.
Figure 12B:
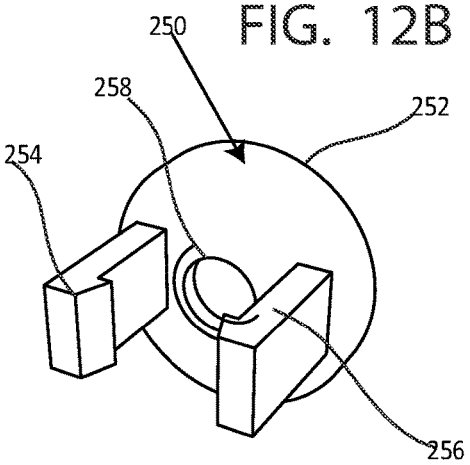
FIG. 12B is a bottom perspective view of a button.
Figure 12C:
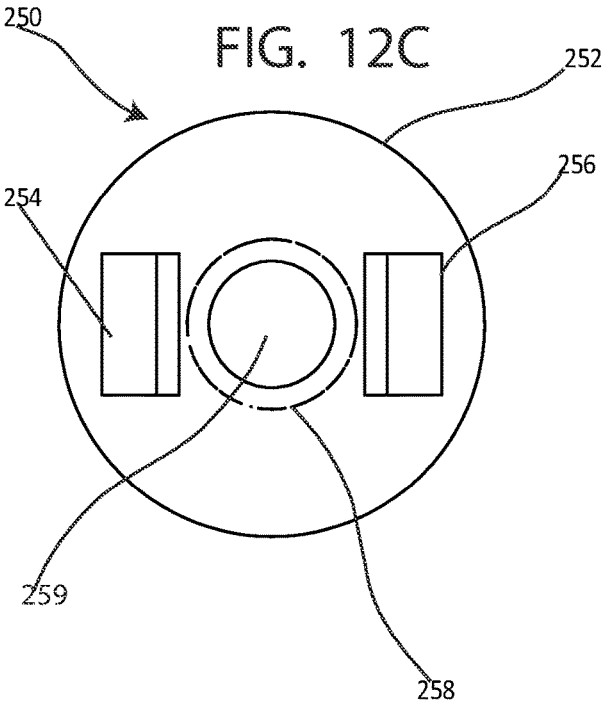
FIG. 12C is a bottom view of the button
Figure 12D:
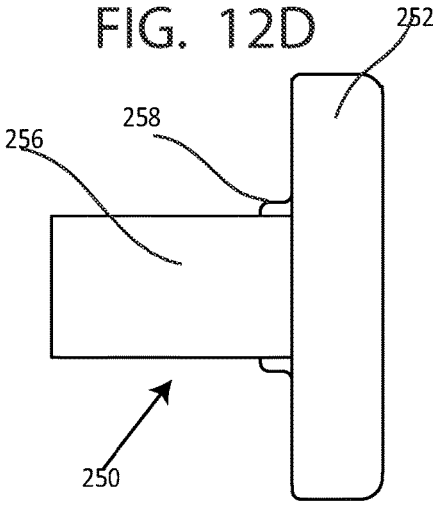
FIG. 12D is a side view of the button.
Figure 13A:
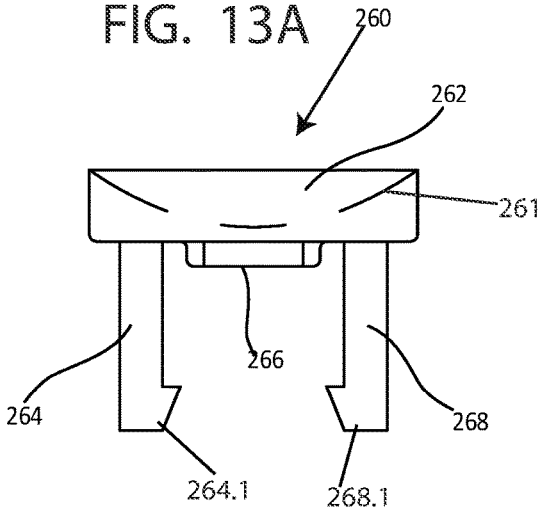
FIG. 13A is a side view of a button.
Figure 13B:
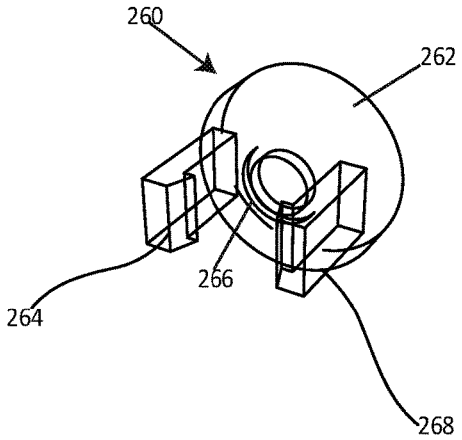
FIG. 13B is a bottom perspective view of a button.
Figure 13C:
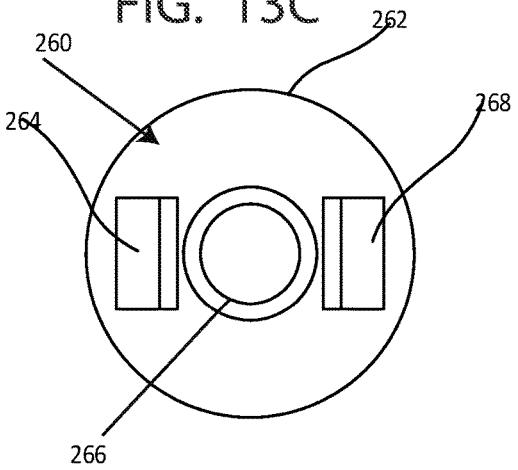
FIG. 13C is a bottom view of the button.
Figure 13D:
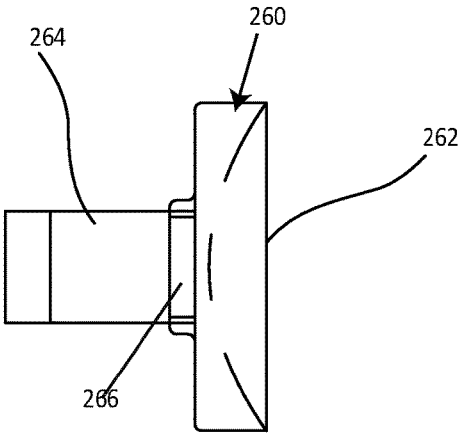
FIG. 13D is a side view of the button.
Figure 14A:
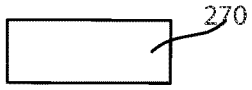
FIG. 14A is a side view of a toggle button.
Figure 14B:
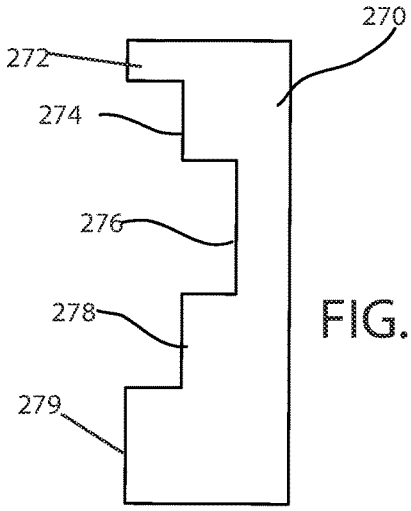
FIG. 14B is a side view of the toggle button.
Figure 14C:
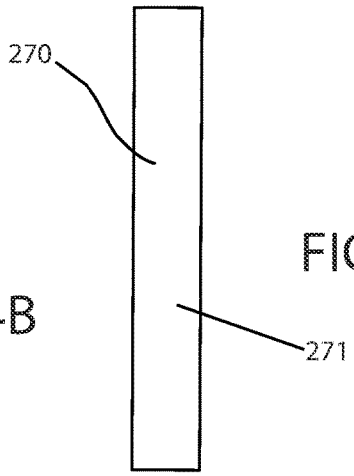
FIG. 14C is a top view of the toggle button.
Figure 14D:
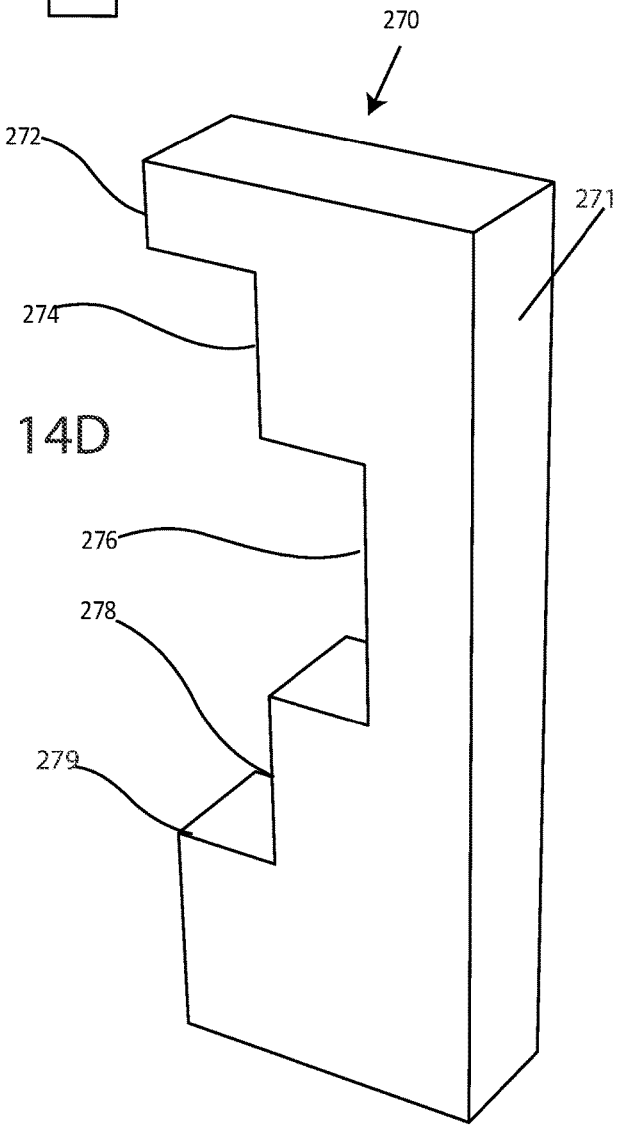
FIG. 14D is a perspective top view of the toggle button.

FIGS. 12A, 12B, and 12C are configured as associated buttons 250. This button 250 includes a top section 252, an underside ridge 258 as well as arms 254 and 256. Ridge 258 is configured circular underneath top section 252. When an individual presses on top section 252, it presses arms 254 and 256 down thereby pressing ridge 258 down to press down an associated switch that is disposed on a motherboard such as motherboard 300.

FIGS. 13A-13D shows alternative buttons which can be used for buttons 208, and 230 as well as buttons 210, 212, 214, and 216. These buttons 260 include a top 262, arms 264, and 268 wherein each of these arms have catches 264.1 and 268.1 which help to lock the button inside of the housing. Ridge 266 is configured to contact an inside button on a circuit board (See FIG. 15). Button 260 includes a curved or indented portion 261 which allows the user to have the tactile sensation of a feeling different from the outside housing surface so that when the user runs their finger across button 260, the user can know that this object is a button rather than the rest of the housing.

FIGS. 14A-14D shows, a button support 270 which is used to support the buttons 218 (see above with respect to FIGS. 8, 9A-9C and 11A-11D. This button support is configured to support the other buttons and includes a back portion 271 which is configured to be coupled to the inside face of the back housing 238, as well as side arms 272, and 279. There are also shorter arms 274 and 278, as well as a center indented bridge section 276. Bridge section us supported by a central support (See central support 326 on board 300 in FIG. 17. This support allows the rocker arm to rock back and forth from one side to another to press down on contacts 324 and/or contact 330 on motherboard 302. This button support 270 is configured to support these buttons 250 and 260 inside of the housing so that they can be pressed and released inside of the housing.

Figure 15A:
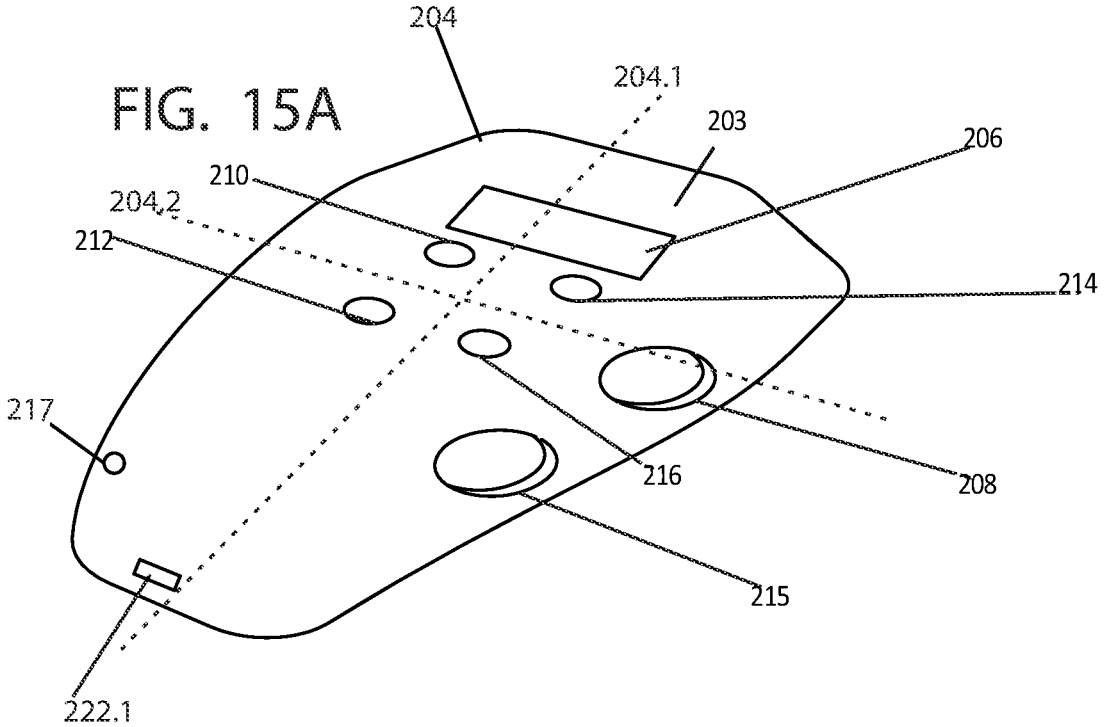
FIG. 15A is a front perspective view of another controller.

FIG. 15A is a front perspective view of another controller 203 which has a body 204 having a longitudinal axis 204.1 and a latitudinal axis 204.2. As described above the body is oblong in shape with rounded sides and is configured to fit insude of a user's hand in an ergonomic manner. This controller has a screen 206. In addition, this controller has a button array of buttons 210, 212, 214, and 216 however these buttons are programmed differently. For example, button 210 is a stopwatch. Button 212 is a clock/counts switch display which allows the user to switch the display 206 from the clock to the counts of balls/strikes on display 206. Button 214 is an undo button, which allows the user to undo the previous increment, while button 216 is a pitch count button. Button 208 is also the same as the previous button 208 as well. Button 215 is new. This new button 215 is configured as an innings button. Screen 206 is also the same as shown in FIG. 8A as well.

Figure 15B:
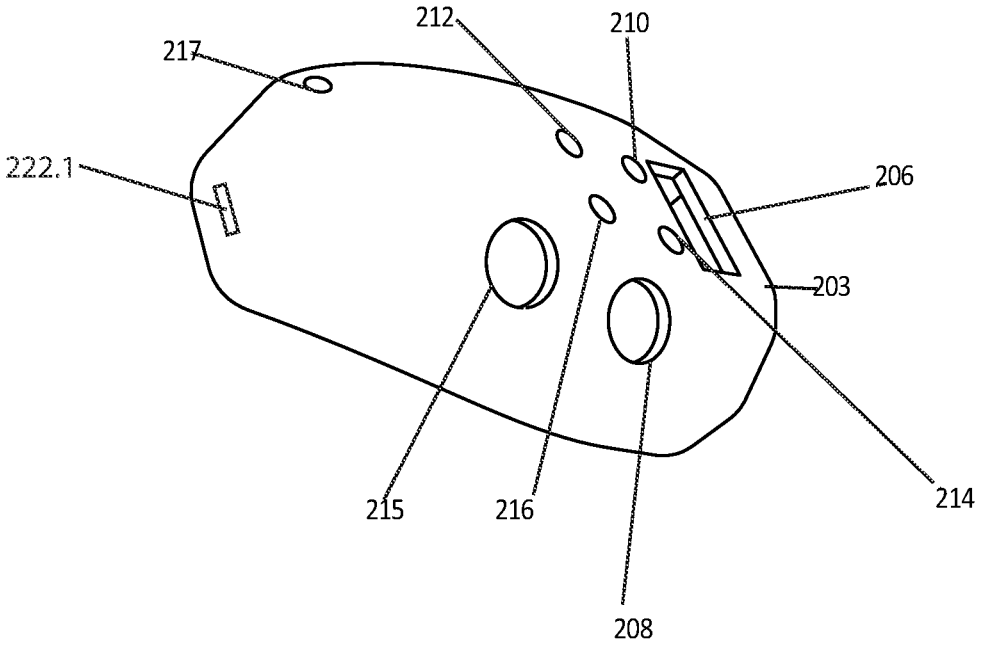
FIG. 15B is a side perspective view of the controller of FIG. 15A.

FIG. 15B is a side perspective view of the controller of FIG. 15A which also shows buttons 208, 215, as well as buttons 210, 212, 214, and 216 as well as port 228 Port 222.1 is an input/output port for inputting power or information and outputting information as well. Port 217 is for allowing a tether or lanyard to be attached.

Figure 16A:
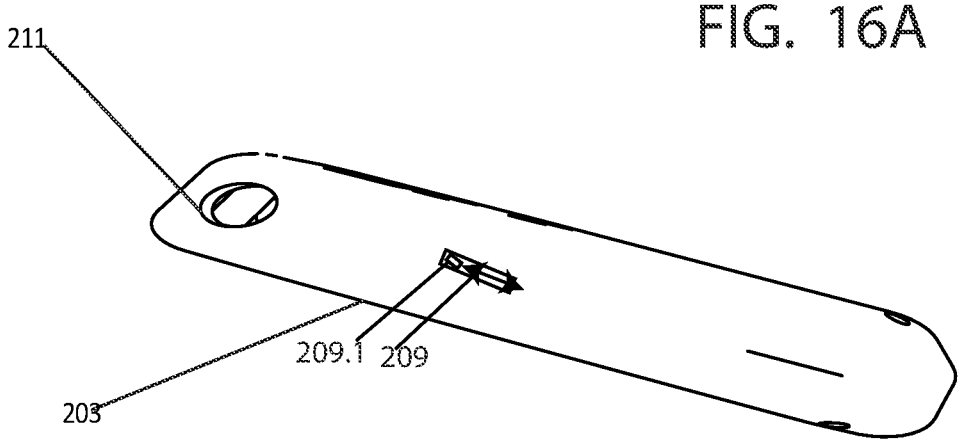
FIG. 16A is a left side view of the controller of FIG. 15A based upon the orientation of FIG. 15A.

FIG. 16A is a left side view of the controller of FIG. 15A based upon the orientation of FIG. 15A. This left side shows button 211 which is the strikes/foul ball button as well.

Figure 16B:
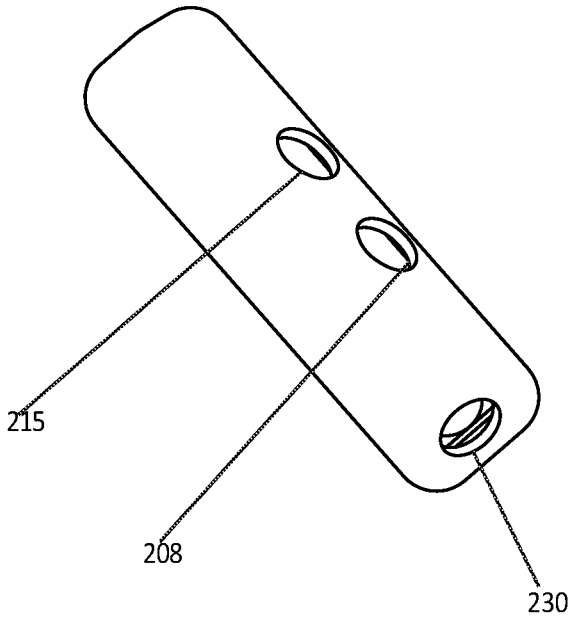
FIG. 16B is a right side perspective view of the controller based upon the orientation of FIG. 15A.

FIG. 16B is a right side perspective view of the controller based upon the orientation of FIG. 15A. This view shows buttons 215 and 208 as well as top button 230 functioning as an outs button as well.

Figure 17:
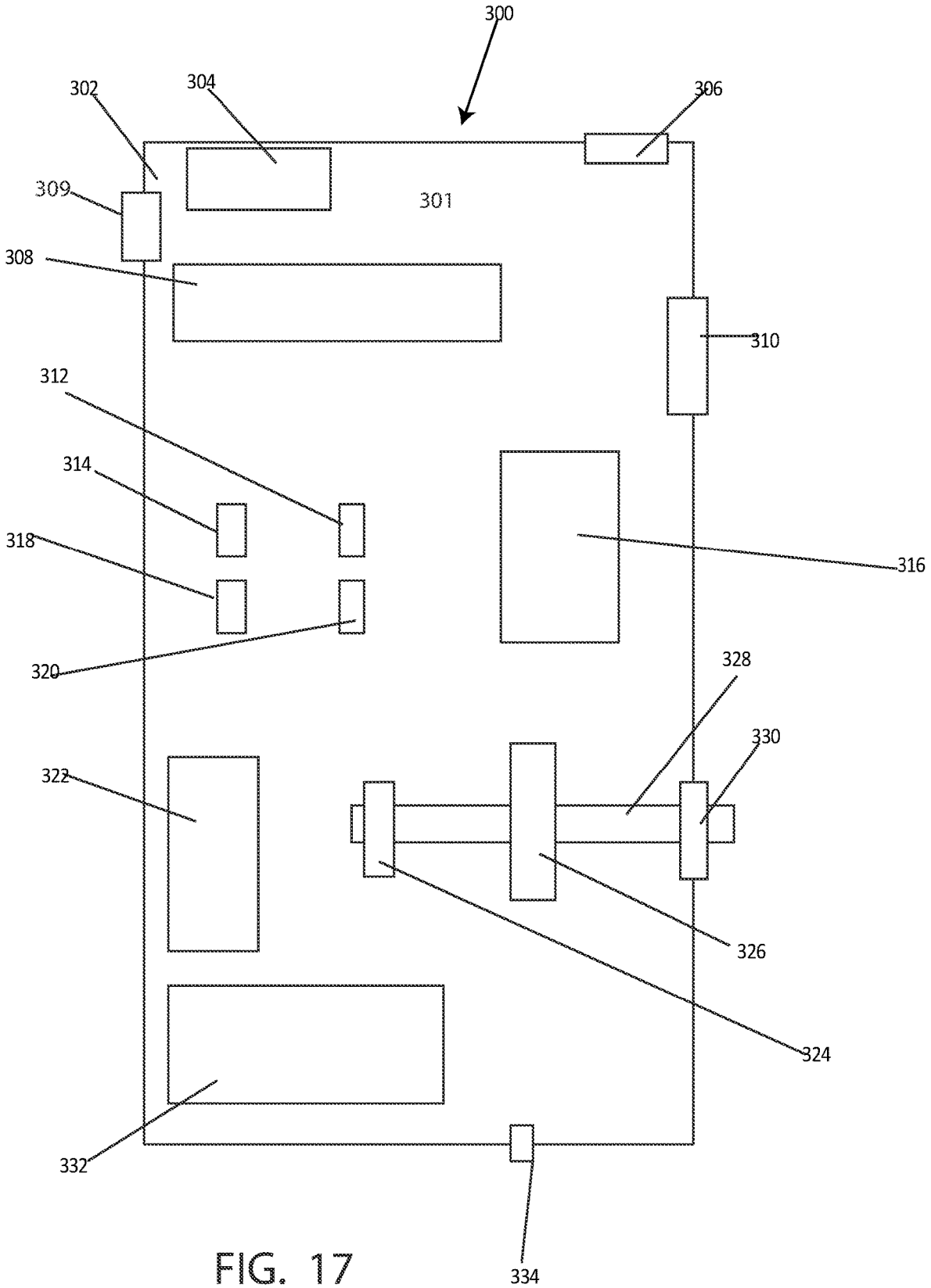
FIG. 17 is a plan view of a motherboard/controller for the embodiment shown in FIG. 8A.

FIG. 17 is a view of a device 300 having a motherboard 301 which is a different motherboard than the motherboard shown in FIG. 5. This motherboard is configured to be positioned below the different buttons shown in the housing of FIG. 8. With this design the motherboard has a board section or motherboard 302 which houses the different components on the board. For example, there is a wireless transponder 304, an update button 306 which is associated with button 230, a button 310 which is associated with button 208, as well as buttons 312, 314, 318 and 320 associated with buttons 210, 212, 214, and 216. Rocker button 270 is associated with button 218 which is positioned above button(s) 324, and 330. Rocker arm 270 is supported by a central support 326 which allows the rocker arm to rock back and forth. Thus, when a user holds down a button such as button 208 corresponding to button 310, this allows for specialized updating of the balls wherein the user can then use the rocker button to increase the number of balls or decrease the number of balls accordingly. Once the number of balls is set, the user can then press button 208 corresponding to button 310 on the motherboard to finalize the count of balls. In addition, the same can be done for button 230 which sets the number of outs. The user can hold this button and then once the number of outs starts flashing the user can use the rocker button to rock the button to the left to decrease the number of outs or rock the button to the right to increase the number of outs. Once the number of outs is set properly, the user can press the button 230 again to finalize the number of outs. Furthermore, button 211 can be pressed which corresponds to button 309 on the motherboard. When a user holds this button 211 down the number of strikes can start flashing. The user can then use the rocker button 218 to rock either to the left to reduce the number of strikes or rock to the right to increase the number of strikes accordingly. Once the correct strike count is set, the user can then press button 211 again to finalize the strike count.

Disposed on this motherboard is screen 308 associated with screen 206. There is also disposed on this motherboard a microprocessor 316, as well as memory 322 and battery 332. The microprocessor is configured to be fed information from memory 322 and to run the process shown in FIG. 7. Input and output port 334 is also shown, with one for charging battery 332 as well as on for allowing for further programming of the device. In addition, button 309 on motherboard 300 corresponds to button 211 above.

Figure 18:
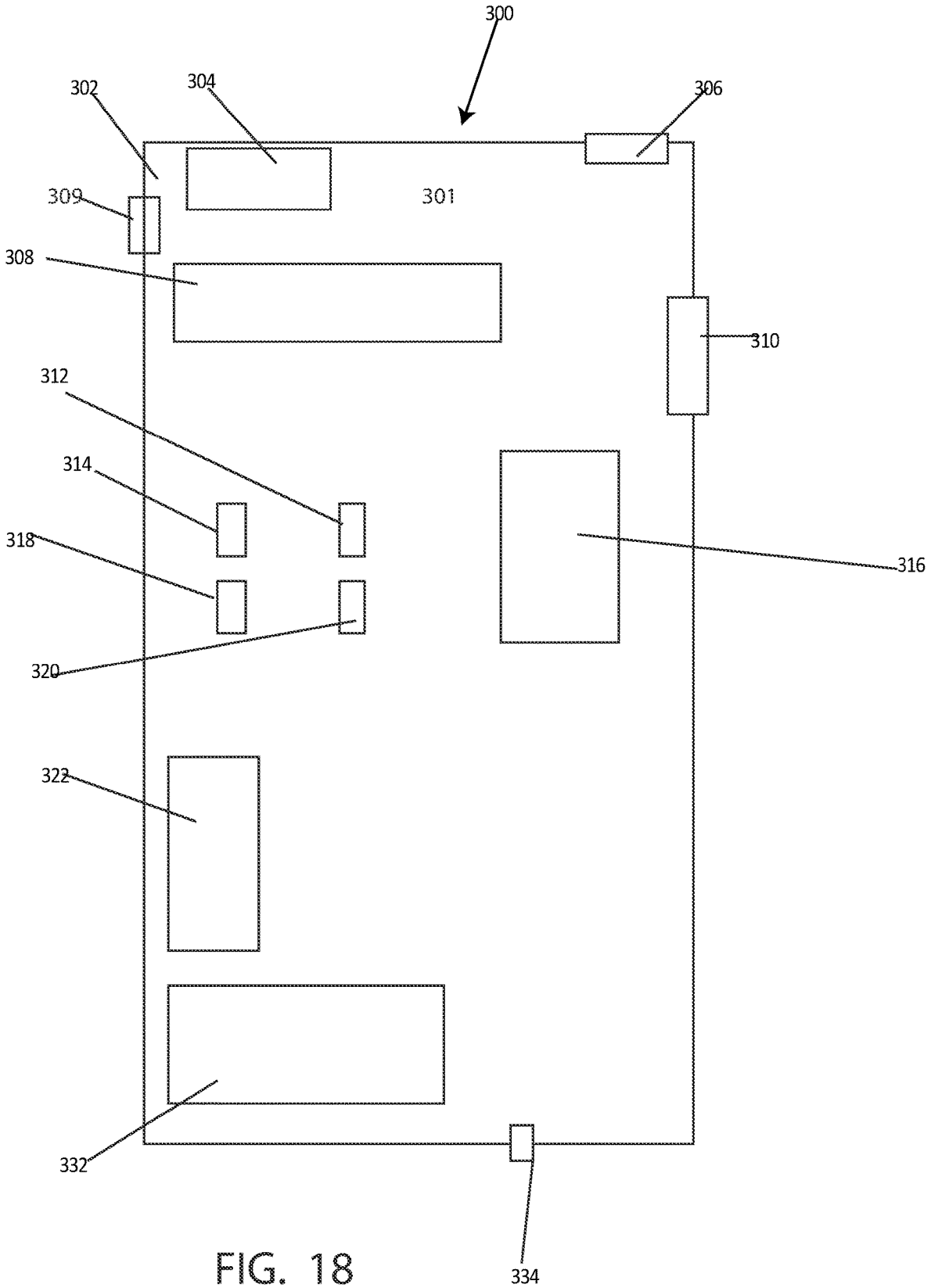
FIG. 18 is another view of another motherboard controller.

FIG. 18 is another view of another motherboard controller. All of the components described above in FIG. 17 are present except for the rocker buttons 324, 330 as well as rocker supports 328, and 326.

Figure 19:
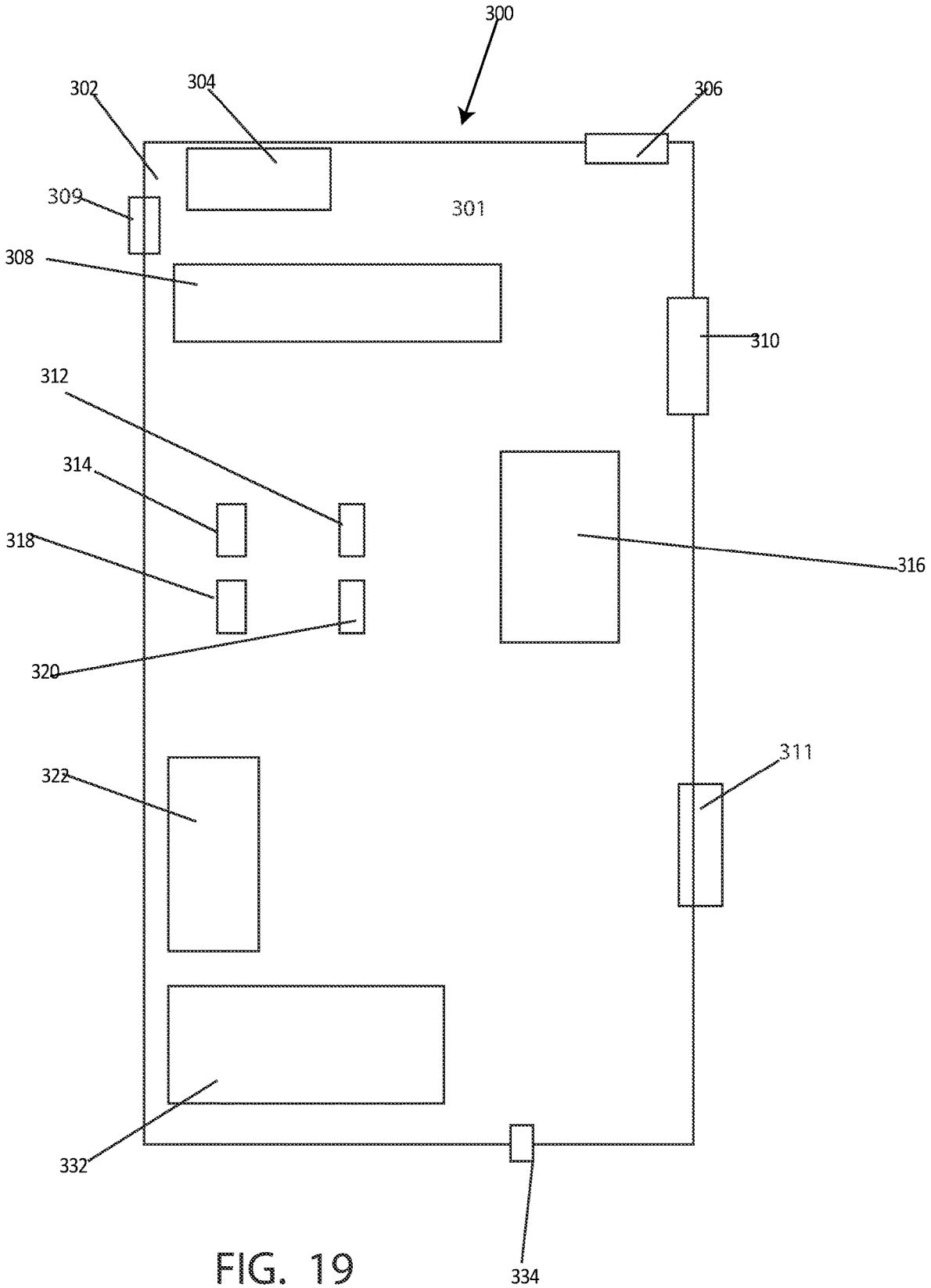
FIG. 19 is another view of another motherboard controller.

FIG. 19 is another view of another motherboard controller. This view has all of the same buttons as FIG. 18 however it also includes button 311 which corresponds to button 215 shown above in FIG. 15A. Thus the underlying buttons on FIG. 19 of the motherboard are programmed differently than the motherboard of FIG. 17. For example, button 314 is programmed as a stopwatch, button 312 is programmed as a clock/counts (switch display) button, button 318 is programmed as an undo button, while button 320 is programmed as a runs button. Buttons 314, 312, 318, and 320 correspond to buttons 210, 214, 212, and 216 respectively on FIG. 15A.

Figure 20:
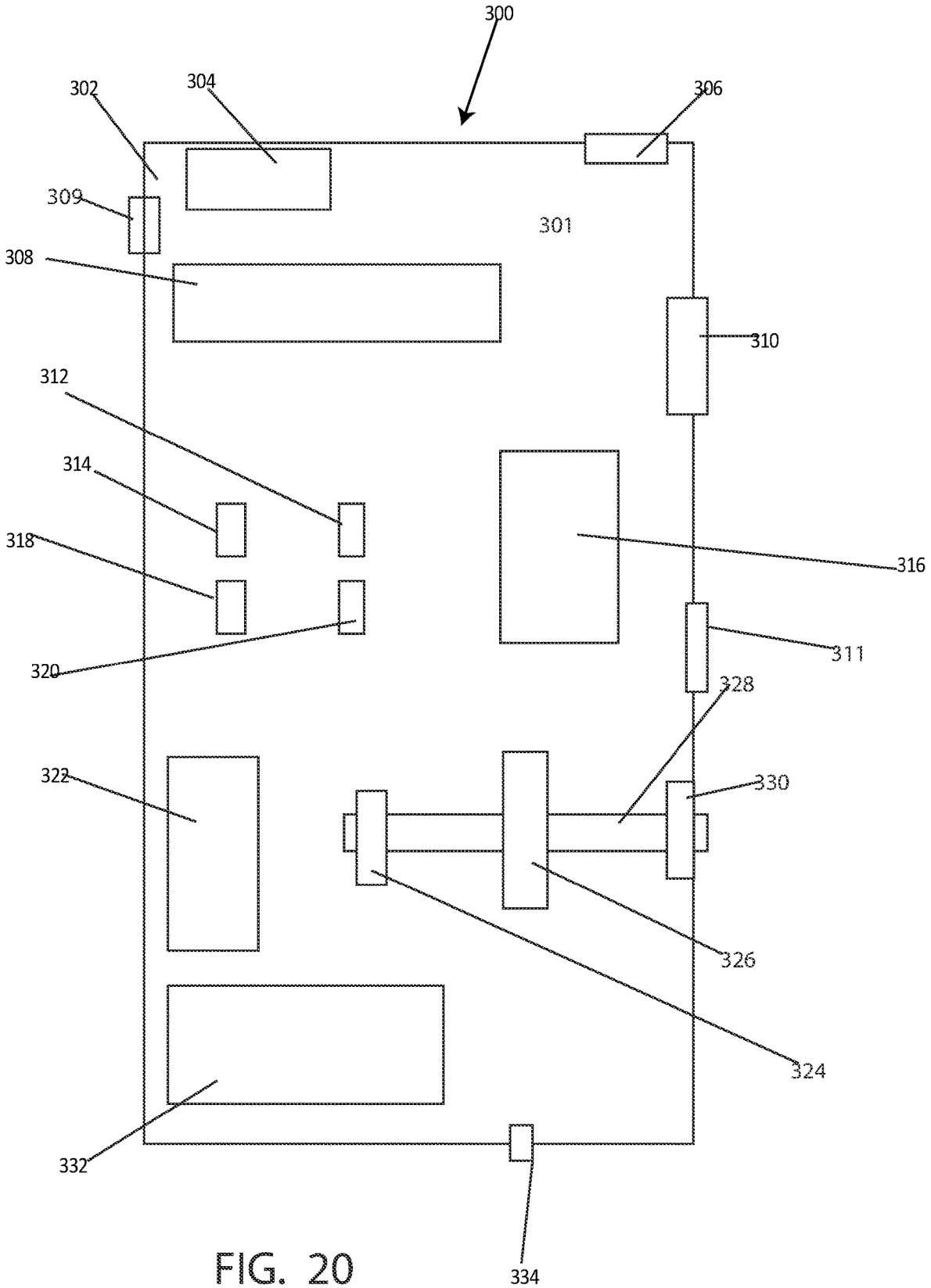
FIG. 20 is another view of another motherboard controller.

FIG. 20 is another view of another motherboard controller. This view shows all of the buttons of FIG. 19 but also includes the rocker buttons 324, and 330 as well as rocker supports 326 and 328.

Figure 21:
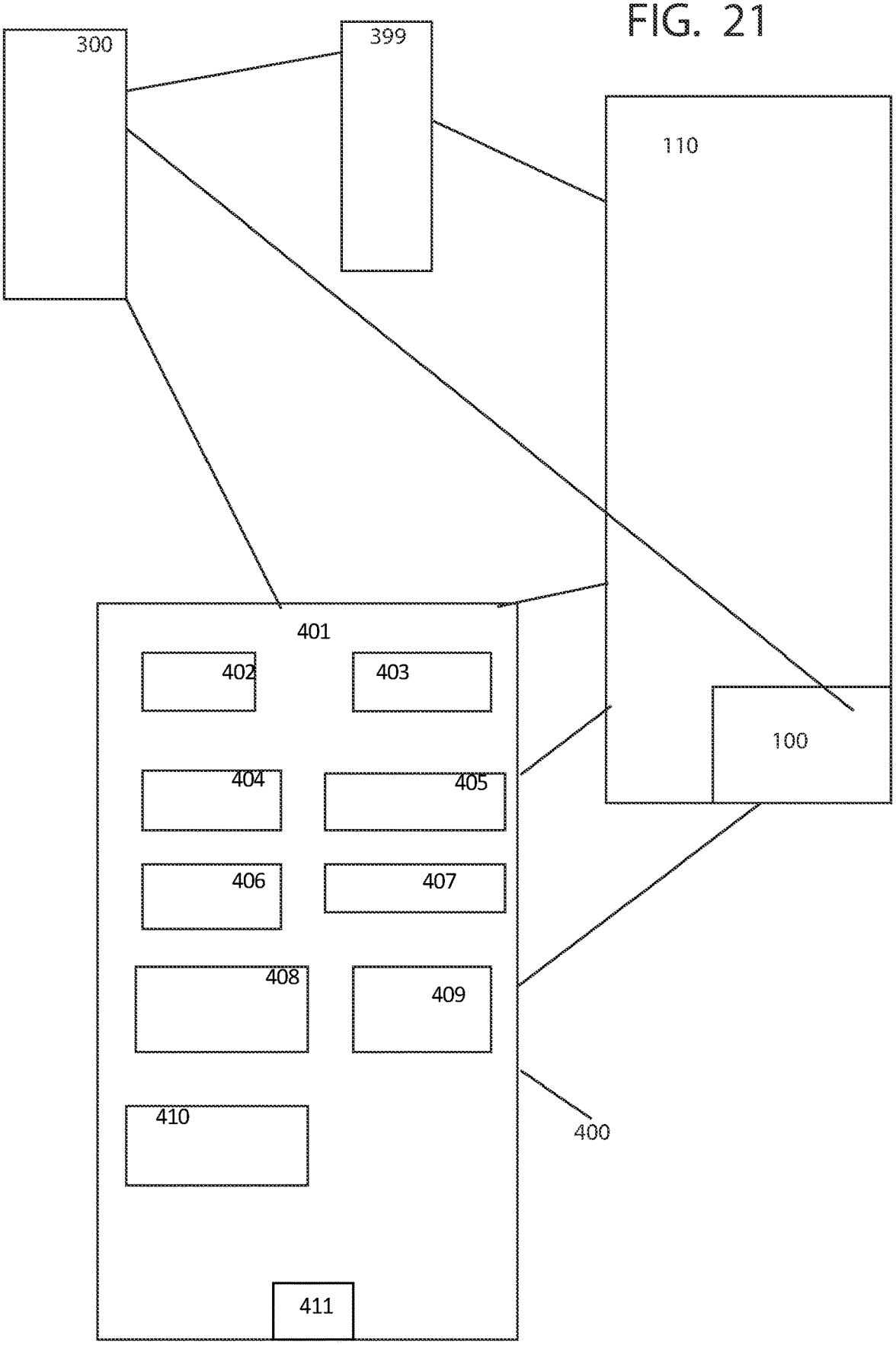
FIG. 21 is a view of a network for communicating with the device.

FIG. 21 is also another view of a means for communication between the device 300 and the other electronic components. For example, there is the indicator/change device 300 which is in communication with server 100 as well as scoreboard 110 (See FIG. 6 above). In addition, there is a portable smartphone 400 which is configured to communicate with the device 300 via any suitable means such as via wireless WIFI, radio frequency Bluetooth, cellular transmission etc. This portable phone 400 includes the following components a motherboard 401, a processor or microprocessor 402, a memory 403, a battery 404, a gyroscope 405, a WIFI transceiver 406, a cellular transceiver 407, a camera 408, a screen 409, a Bluetooth transceiver 410 and an input/output port 411.

Essentially the updater device 300 is configured to communicate with a cellular telephone or portable smart phone or any other device designated for this functionality to update the pitch count as well as the outs and the innings so that a user of the smartphone does not have to do this already.

There is also another optional updater device 399 which is configured similar to updater 300 and which is configured to be held/controlled by a base umpire or other designated controller instead of the home plate umpire. The functionality of the buttons of these devices can be changed and programmed so that this updater device 399 can be programmed to take on different responsibilities. For example, device 300 can be responsible for recording strikes/and balls primarily as well as outs. Device 399 can be used to record foul balls, pitch count, runs, hits and outs. These devices 300 and 399 can coordinate together to then send this data onto other devices such as the portable electronic device (telephone) 400 or onto the server 100 or the scoreboard 110. Each of these devices 300 and 399 can also communicate with each other. The means of communication as indicated above can include cellular, WIFI, Bluetooth, radio frequency (RF) or any other suitable form of communication.

For example, for some users of a smartphone there could be an app (software application) which is configured to score the game, including keeping track of strikes, balls, outs foul balls, etc. This app may also allow the user to track the type of hits that a batter makes, the types of pitches (fastball, curveball, changeup etc.) as well as score (subjectively) the quality of the at bat as well as track the pitch count. These types of apps can be quite useful in tracking the statistics of a game and for allowing a coach to determine the quality of play of a particular player. This app can be commonly used by coaches, parents, spectators or any other user interested in following a game.

With the integration of the device 300 with the statistics of a game or partial statistics of a game this allows the user of the updater device 300 to not only update the statistics on a scoreboard such as scoreboard 110 or on server 100 but also update the particularized scoring on a person's phone application. The different forms of communication that can occur between the phone 400 and the updater device 300 can be in the form of direct communication via Bluetooth, or via connection via Wi-Fi or cellular, radio frequency (RF) or any other suitable wireless connectivity (direct connection) or connection through server 100. Thus, the work performed by the umpire can then be shared with different users so that this work can then be create through a community of users.

Figure 22:
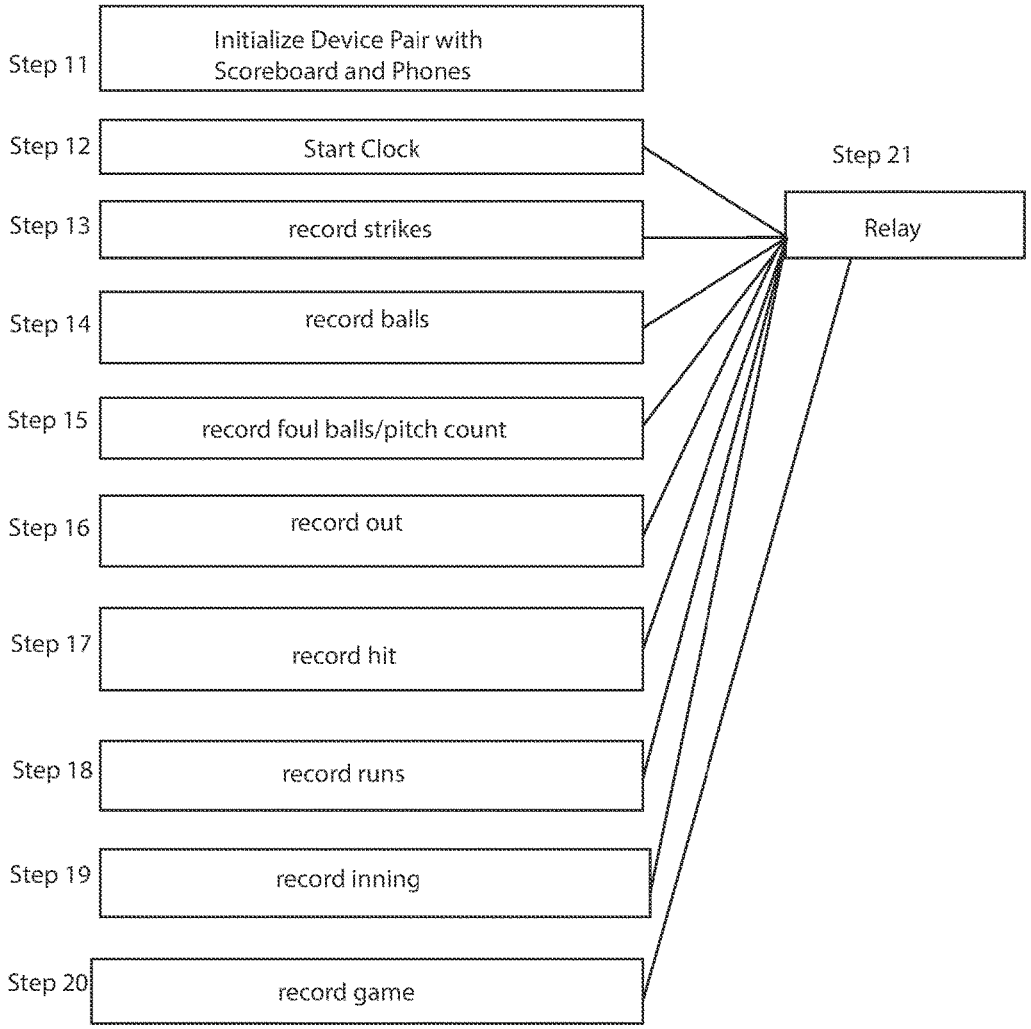
FIG. 22 is a flow chart for the process for the second communicating device.

FIG. 22 is a flow chart for the process for using the devices 300 and/or 399 as shown in FIG. 21. For example, the process starts in step 11 which starts with the step of initializing and pairing these devices with a scoreboard such as scoreboard 110 and/or the server 100 as well as at least one portable device such as a phone 400. Next, in step 12 the system starts the clock. The start of the clock can be upon the recordation of the first pitch in a game. The recordation of the first pitch in a game can occur via either the recordation of a strike which occurs by pressing button 211, ball by selecting button 208, innings button 210, a runs button or out or any other suitable recordation of an event. Next, in step 13 the system can be used to record strikes by pressing button 211, or in step 14 the system can be used to record balls by pressing button 208, or in step 15 the system can be used to record foul balls via button 216 or record the pitch count. Next, in step 16 the system can record an out via button 230. Next, in step 17 the system can record a hit via the user pressing and holding a button such as any suitable button such as button 218. Next, in step 18 the system can record the runs, such as when a user presses on button 212. Next, in step 19 the system can record the change in an inning or a side by the user presses innings button 210. Next, when the game advances through the pre-set number of innings, the system can record the whole game. Each of these steps is then relayed to another device in step 21 which can happen simultaneous with any one of the steps 12-20. The relay of this information can be from the device 300 to any one of the other peripheral devices such as device 399, portable smartphone 400, scoreboard 110, server 100 or any other suitable device.

Figure 23:
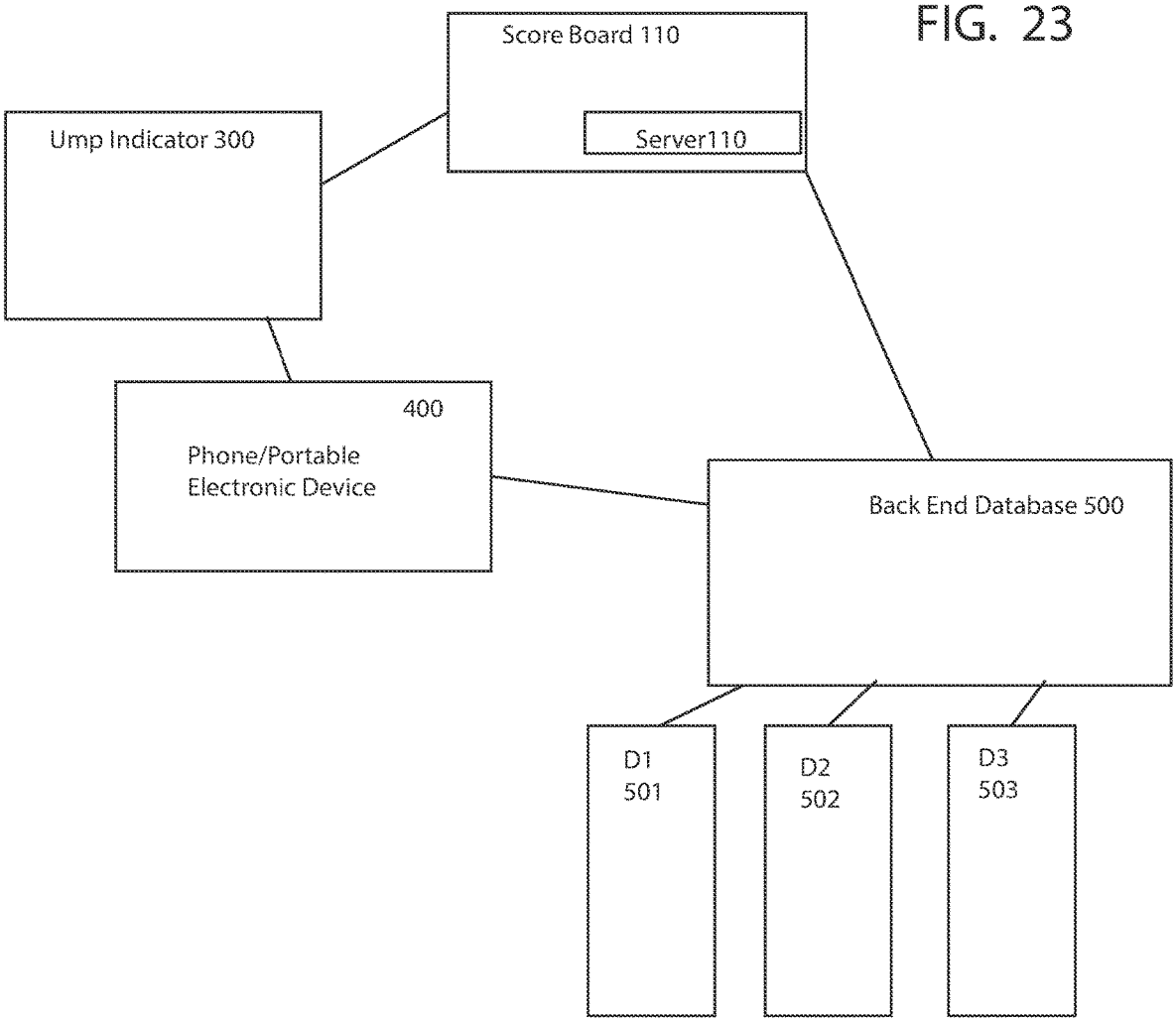
FIG. 23 is a schematic block diagram of another layout for data communication.

FIG. 23 is a schematic block diagram of another layout which shows an ump indicator 300 which is representative of the ump indicators shown in FIG. 1, FIGS. 8A, and 15A. This ump indicator 300 is in communication via any suitable communication protocol such as WIFI, cellular, Bluetooth, or any other suitable communication protocol with a scoreboard 110 and/or server 100 as well as a portable electronic device 400 such as a smartphone. Through either the server 110 or the portable electronic device 400, this indicator can relay information up to a back end database 500 serving other electronic devices such as other smartphones such as devices 501, 502, and 503 etc. which have installed on them an application or (app) which records the strikes, balls, outs, hits and other significant events in a game.

Information that is relayed through these devices can be in any form. However in at least one instance, the information that is relayed is in the form of strikes, balls, and outs for each sequential batter as shown in FIG. 24.

Figure 24:
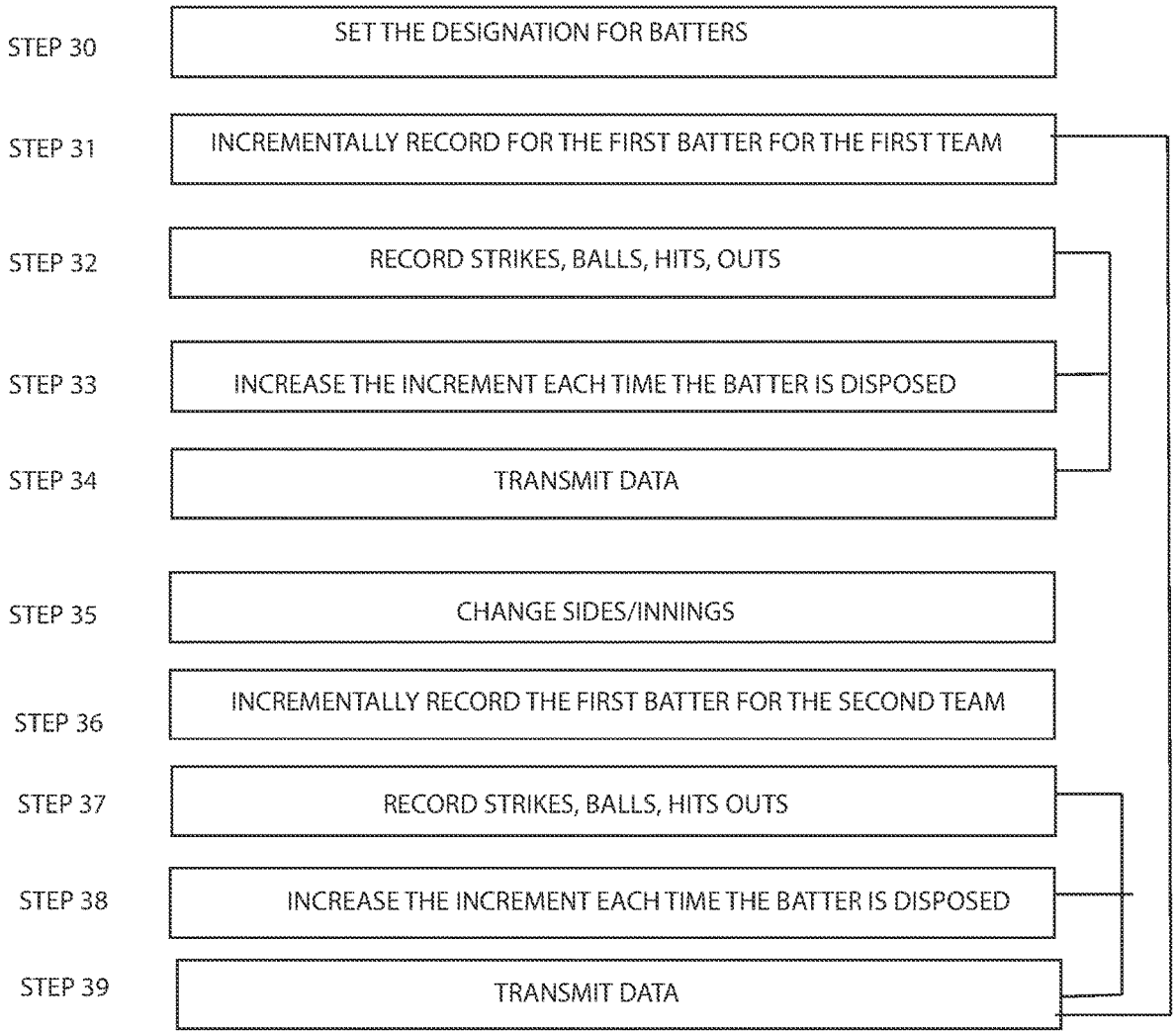
FIG. 24 is a flow chart for recording and updating a data flow.

FIG. 24 is a flow chart for the recording and passing of information from an ump indicator 300. For example, in the first step, the system (Ump indicator 300) initializes a first designation of batters. For example, in a seven inning game at the very least, each side would have 21 batters. Therefore, the order of each batter would for example be T1-1 (for team 1-batter 1). The second batter on team 1 would be T1-2 and so on.

Alternatively when there is a switch in the sides, the system would switch the designation to T2-1 for the first batter of the second team. The umpire can for each batter record the batters balls, strikes, and hits (if necessary), as well as outs. This can then be sent as a stream of data to other applications to be matched with these more particular applications. For example, the process continues wherein in step 31 the umpire incrementally records the meeting of the batter with the plate. The umpire then in step 32 records each strike, ball, hit or out, resulting in the eventual disposition of the batter. After each batter is disposed, in step 34 the system transmits the data to update a central database 500. Once the sides change in step 35 a new side of batters is recorded. Thus, the process turns to step 36, wherein the umpire using ump indicator device 300 lines up or sets the first batter for the other side to the plate. This can occur automatically by simply rendering the third out from the previous side of the inning resulting in a change in sides. Next, in step 37, the umpire can then record the strikes, balls, hits and outs of that batter. Once that batter is disposed of, the umpire can then in step 38 increase the increment on the next batter from that side. This can occur automatically either by the umpire recording an out or by the umpire recording a hit. Right after increasing the increment of the batter the system can then transmit the results of the previous batter in step 39 to central database 500. The process can continue through the different innings such as through 6 innings for youngest little league ball, 7 innings for moderate level baseball or 9 innings for adult or young adult level baseball until the game ends.

Thus, there is created a universally programmable umpire indicator device which is ergonomically designed to help an umpire hold the device and keep score of a game such as a baseball game in real time without being disturbed from his primary duties.

Accordingly, while at least one embodiment of the present invention have been shown and described, it is to be understood that many changes and modifications may be made thereunto without departing from the spirit and scope of the invention as defined in the appended claims.

What is claimed is:

1. A system for controlling a scoreboard comprising:
a hand held device comprising:
a housing having a plurality of faces comprising front face, a right side face, a back face, a left side face, a bottom face, and a top face;
a display screen coupled to the housing;
a plurality of buttons coupled to the housing; and
wherein at least one face of said plurality of faces is curved;
at least one relay, wherein said at least one relay is configured to communicate with said hand held device and said scoreboard;
wherein the device further comprises a timer and wherein the device further comprises a contact for starting the timer and wherein said timer is configured to provide at least one initial time warning when a game becomes close to its allotted time;
wherein at least one button is a pitch count button and wherein the hand held device further comprises a vibrating annunciator.

2. The hand held device as in claim 1, wherein a curvature of the curved face is convex.

3. The hand held device as in claim 1, wherein the curvature of the face is concave.

4. The hand held device as in claim 1, wherein said plurality of buttons comprise at least one of a screen functionality button, an undo button, a strikes button, an outs button, an innings button and a balls button.

5. The device as in claim 4, wherein the balls button is on an opposite face from said strikes button.

6. The device as in claim 4, wherein said outs button and said innings button are on a same side as said strikes button.

7. The device as in claim 6, wherein said balls button, said strikes button, said innings button and said outs button are coupled together on a motherboard disposed inside of said housing.

8. The device as in claim 1, wherein at least two faces of said plurality of faces are curved.

9. The device as in claim 1, wherein at least two buttons of said plurality of buttons are located on said front face.

10. The device as in claim 9, wherein said display screen is located on said front face.

11. The device as in claim 10, wherein the buttons on the front face comprise a screen functionality button and an undo button.

12. The device as in claim 11, wherein said right side face is concave.

13. The device as in claim 12, wherein there are at least three buttons disposed on said right side face.

14. The device as in claim 13, wherein said at least three buttons on said right side face comprise at least a strikes button, an innings button and an outs button.

15. The device as in claim 13, wherein said left side face is convex and wherein the device further comprises a balls button disposed on said left side face.

16. The system as in claim 1, wherein the handheld device further comprises at least one button that is a recessed button having a concave surface.

17. A system for controlling a scoreboard comprising:
a hand held device comprising:
a housing having a plurality of faces comprising front face, a right side face, a back face, a left side face, a bottom face, and a top face;
a display screen coupled to the housing;
a plurality of buttons coupled to the housing; and
wherein at least one face of said plurality of faces is curved;
at least one relay, wherein said at least one relay is configured to communicate with said hand held device and said scoreboard;
wherein at least one button is a pitch count button and wherein the hand held device further comprises a vibrating annunciator;
wherein the hand held device further comprises an antenna.

18. A system for controlling a scoreboard comprising:
a hand held device comprising:
a housing having a plurality of faces comprising front face, a right side face, a back face, a left side face, a bottom face, and a top face;
a display screen coupled to the housing;
a plurality of buttons coupled to the housing; and
wherein at least one face of said plurality of faces is curved;
at least one relay, wherein said at least one relay is configured to communicate with said hand held device and said scoreboard;
wherein the handheld device further comprises at least one processor, wherein said at least one processor is configured for auto population of statistics which allows for the device to automatically roll over the inning once the device receives an instruction of a third out.

19. A system for controlling a scoreboard comprising:
a hand held device comprising:

a housing having a plurality of faces comprising front face, a right side face, a back face, a left side face, a bottom face, and a top face;

a display screen coupled to the housing;

a plurality of buttons coupled to the housing; and wherein at least one face of said plurality of faces is curved;

at least one relay, wherein said at least one relay is configured to communicate with said hand held device and said scoreboard;

wherein at least one button is a pitch count button and wherein the hand held device further comprises a vibrating annunciator;

wherein the hand held device is configured to communicate with a cell phone.

* * * * *